US011510441B2

(12) United States Patent
North et al.

(10) Patent No.: US 11,510,441 B2
(45) Date of Patent: Nov. 29, 2022

(54) PANTS CONFIGURED FOR ENHANCING WORKER MOBILITY

(71) Applicant: Workwear Outfitters, LLC, Nashville, TN (US)

(72) Inventors: Shannon North, Murfreesboro, TN (US); David Griffin, Nashville, TN (US); Ben Rose, Royston (GB); Ismail Akram, Moseley (GB); Paul Gibson, Leamington Spa (GB)

(73) Assignee: Workwear Outfitters, LLC, Nashville, TN (US)

( * ) Notice: Subject to any disclaimer, the term of this patent is extended or adjusted under 35 U.S.C. 154(b) by 592 days.

(21) Appl. No.: 16/176,798

(22) Filed: Oct. 31, 2018

(65) Prior Publication Data

US 2019/0059463 A1 Feb. 28, 2019

Related U.S. Application Data

(62) Division of application No. 14/813,867, filed on Jul. 30, 2015, now Pat. No. 10,362,814.

(Continued)

(51) Int. Cl.
*A41D 1/06* (2006.01)

(52) U.S. Cl.
CPC ..... *A41D 1/06* (2013.01); *A41D 2300/22* (2013.01); *A41D 2600/20* (2013.01)

(58) Field of Classification Search
CPC .. A41D 1/06; A41D 2300/22; A41D 2600/20; A41D 2300/20
See application file for complete search history.

(56) References Cited

U.S. PATENT DOCUMENTS 472,273 A * 4/1892 Rupprecht ..... A41F 9/02 2/237
1,797,115 A * 3/1931 Atkinson ..... A41F 9/02 2/401

(Continued)

FOREIGN PATENT DOCUMENTS

CN 2497563 7/2002
CN 102271544 A 12/2011

(Continued)

OTHER PUBLICATIONS

Rocky Mountain ATV*MC Klim Mojave Pant 2014—Rocky Mountain ATVMC website as of Sep. 13, 2014 according to the Wayback Machine at http://web.archive.org/web/20140913130229/http://www.rockymountainatvmc.com/p/741/42508/Klim-Mojave-Pant-2014.

(Continued)

*Primary Examiner* — Richale L Quinn
(74) *Attorney, Agent, or Firm* — Waller Lansden Dortch & Davis, LLP; Blake M. Bernard

(57) ABSTRACT

The present invention provides pants, such as pants that are worn as work uniform pants, which are configured to provide significant improvements in a wearer's comfort, performance, and mobility over a predefined range of motions. Embodiments of the pants comprise one or more stretch panels that are configured to provide for stretching of the pant at an identified micro site in order to provide a wearer with enhanced mobility. Additionally, the manner in which the various portions of the pant are connected together may be adjusted in order to provide a wearer with enhanced mobility.

18 Claims, 12 Drawing Sheets

Related U.S. Application Data

(60) Provisional application No. 62/031,015, filed on Jul. 30, 2014.

(56) References Cited

U.S. PATENT DOCUMENTS 2,250,218 A * 7/1941 Cadous ..... A41B 9/04 2/401
2,334,311 A * 11/1943 Cadous ..... A41D 1/06 2/227
2,344,375 A * 3/1944 Stephens ..... A41B 9/04 450/104
2,983,924 A * 5/1961 Cohen ..... A41D 7/005 2/67
3,512,532 A * 5/1970 Sutter ..... A41C 1/006 450/98
4,890,337 A * 1/1990 Greenberg ..... A41D 1/06 2/220
4,937,883 A 7/1990 Shirai
D317,074 S * 5/1991 Beasley ..... D2/742
5,033,123 A 7/1991 Audet
5,038,408 A * 8/1991 DeBaene ..... A41D 13/0587 2/23
5,052,053 A 10/1991 Peart et al.
5,072,454 A 12/1991 Trahan
5,367,708 A * 11/1994 Fujimoto ..... A61F 13/143 2/22
5,431,030 A 7/1995 Ishizaki et al.
5,737,773 A 4/1998 Dicker et al.
5,888,118 A * 3/1999 Kishi ..... A41D 1/14 450/122
5,901,374 A 5/1999 Foster
6,076,187 A 6/2000 Wallerstein
6,186,970 B1 * 2/2001 Fujii ..... A41D 13/0015 602/75
6,212,686 B1 4/2001 Krause et al.
6,279,161 B1 8/2001 Johnston
6,311,333 B1 11/2001 Batra
6,363,538 B1 * 4/2002 Davis ..... A41D 1/08 2/247
6,446,264 B2 9/2002 Fairhurst et al.
6,874,337 B2 * 4/2005 Uno ..... A41B 9/001 66/177
7,074,204 B2 * 7/2006 Fujii ..... D04B 21/207 602/75
7,146,647 B2 12/2006 Krause et al.
7,229,390 B2 * 6/2007 Fujii ..... A41D 1/08 482/124
7,310,824 B2 * 12/2007 Walsh ..... A41D 27/10 2/122
7,526,929 B2 * 5/2009 Takamoto ..... A41B 11/14 66/177
7,546,853 B2 6/2009 Rock et al.
7,707,658 B2 * 5/2010 Culhane ..... A41D 3/00 2/227
7,721,356 B2 5/2010 Utaka
7,730,552 B2 * 6/2010 Ota ..... A41D 31/18 2/69
7,849,522 B2 * 12/2010 Roux ..... A41D 1/089 2/227
7,886,367 B2 * 2/2011 Chapuis ..... A61F 13/06 2/69
7,913,323 B2 3/2011 Takamoto et al.
7,937,771 B2 * 5/2011 Mazzarolo ..... A41D 13/0015 2/69
7,941,871 B1 * 5/2011 Jorgensen ..... A41D 7/005 2/238
7,950,069 B2 * 5/2011 Lee ..... A41D 27/26 2/227
8,347,415 B2 1/2013 Mazzarolo
8,418,268 B2 * 4/2013 Waldman ..... A41D 1/06 2/248
8,656,515 B2 2/2014 Newton et al.
8,732,865 B2 * 5/2014 Ishikawa ..... A41D 1/06 2/227
9,095,177 B2 * 8/2015 Ota ..... A41D 13/0015
9,320,306 B2 * 4/2016 Freddi ..... A41D 1/06
9,596,893 B2 * 3/2017 Fukuyo ..... A63B 21/4025
9,642,401 B2 * 5/2017 Yamada ..... A41D 13/065
9,668,525 B2 * 6/2017 Boyle ..... A41D 27/20
9,788,582 B2 * 10/2017 Carrer ..... A41D 1/06
10,051,897 B2 * 8/2018 Freddi ..... A41D 1/08
2002/0138893 A1 * 10/2002 Culhane ..... A41D 3/00 2/79
2003/0028952 A1 * 2/2003 Fujii ..... D04B 21/06 2/400
2003/0208829 A1 * 11/2003 Ragot ..... A41D 7/005 2/67
2004/0111781 A1 * 6/2004 Miyake ..... A41C 1/003 2/69
2005/0210559 A1 9/2005 Gabriele
2005/0239370 A1 * 10/2005 Oyama ..... A41C 1/02 450/99
2007/0067892 A1 * 3/2007 Oyama ..... A41C 1/003 2/227
2007/0118954 A1 * 5/2007 Lee ..... A41C 1/003 2/69
2007/0256217 A1 * 11/2007 Takamoto ..... A41D 31/185 2/401
2008/0250551 A1 * 10/2008 Mazzarolo ..... A41D 13/02 2/456
2009/0172859 A1 * 7/2009 Clement ..... A41D 1/08 2/69
2010/0205710 A1 * 8/2010 Aloy Font ..... A41D 1/089 2/22
2010/0281593 A1 * 11/2010 Aloy Font ..... A41D 31/185 2/22
2010/0299804 A1 * 12/2010 Huang ..... A41D 1/06 2/93
2011/0209263 A1 * 9/2011 Suzuki ..... A41D 31/185 2/67
2011/0283442 A1 11/2011 Jorgenson et al.
2012/0102618 A1 5/2012 Burmeister et al.
2012/0210487 A1 * 8/2012 Albin ..... A41D 1/08 2/69
2012/0210494 A1 * 8/2012 Crockett ..... A41D 1/08 2/227
2012/0233738 A1 9/2012 Blauer et al.
2013/0160181 A1 6/2013 Mohr et al.
2013/0212779 A1 8/2013 Dowling et al.
2013/0217288 A1 * 8/2013 Martin ..... D03D 13/004 442/203
2013/0305425 A1 * 11/2013 Zarabi ..... A41D 1/06 2/69
2014/0143930 A1 * 5/2014 Kuraoka ..... A41D 1/06 2/79
2015/0128331 A1 * 5/2015 Grosse ..... A41D 31/185 2/400
2019/0075858 A1 * 3/2019 Noonan ..... A41D 31/185
2019/0110525 A1 * 4/2019 Conte ..... A41D 1/06

FOREIGN PATENT DOCUMENTS

| | | |
|---|---|---|
| CN | 103140146 A | 6/2013 |
| EP | 1502513 | 2/2005 |
| EP | 2666377 | 11/2013 |
| JP | S5044246 | 12/1975 |
| JP | 2006207056 | 8/2006 |
| WO | 2012043673 | 4/2012 |

OTHER PUBLICATIONS

Rocky Mountain ATV*MC Men's Touring Gear, Pants—Rocky Mountain ATVMC website as of Jun. 24, 2014 according to the Wayback Machine at http://web.archive.org/web/20140624104811/http://www.rockymountainatvmc.com/t/1441/Pants.
International Search Report and Written Opinion for PCT/US2015/042836, dated Oct. 16, 2015, 9 pages.
Chinese Office Action, CN2497563Y, dated Mar. 14, 2018.

(56) References Cited

OTHER PUBLICATIONS

Extended European Search Report for EP15827581, dated Dec. 12, 2017. (10 pages).

* cited by examiner

PANTS CONFIGURED FOR ENHANCING WORKER MOBILITY

The present application is a divisional application of U.S. patent application Ser. No. 14/813,867, filed on Jul. 30, 2015, which claims priority to U.S. Provisional Patent Application No. 62/031,015, filed Jul. 30, 2014, the entire contents of each of which are incorporated herein by reference.

BACKGROUND

1. Technical Field

The present technology generally relates to pants that are configured to provide a wearer with enhanced mobility across a range of movements.

2. Description of the Related Art

Pants designed for work uniforms tend to be subject to tightness and restriction at various locations when the wearer performs various actions. Because in many jobs these actions are regularly repeated, the tightness and restriction of the work pant is often a source of great discomfort. Yet the durability requirements and protective nature of pants designed for work uniforms have previously hindered the design of a work pant that provides for enhanced mobility.

SUMMARY

The present invention provides pants, such as pants that are worn as work uniform pants, which are configured to provide significant improvements in a wearer's comfort, performance, and mobility over a predefined range of motions. Some embodiments of the pants comprise one or more stretch panels that are configured to provide for stretching of the pant at an identified microsite in order to provide a wearer with enhanced mobility, while at the same time maintaining acceptable durability and protection for the wearer.

Embodiments of a pant comprise a first leg portion and a second leg portion, one or more stretch panels located at a micro-site of the first leg and one or more stretch panels located at a micro-site of the second leg, such that each of the stretch panels provides a wearer with enhanced mobility, for example, when performing one or more of the following motions: (a) bending over, (b) squatting, (c) kneeling and twisting, (d) reaching forward and up, and (e) big step. In some embodiments, the pant is also configured to withstand industrial laundering. And in some embodiments, the pant is a segment of a coverall.

In some embodiments, each of the stretch panels comprises a first arm and a second arm. The first arm extends laterally across the front of the leg from at or near the outer-facing side of the leg toward the inner-facing side of the leg and is configured to either align with or be slightly above a wearer's kneecap. The second arm extends downward along the length of the leg and is located at or near the outer-facing side of the leg. The first arm of the stretch panel and the second arm of the stretch panel extend from and coincide at a corner area, i.e. a region that may be considered both part of the first arm and part of the second arm.

Each of the leg portions may comprise a front panel and a rear panel. The front panel and the rear panel are adjoined by at least an outer seam, and usually by an outer seam and an inner seam. In some embodiments, the first arm of the stretch panel extends across the front panel of the leg between the outer seam and the inner seam. In some embodiments, the second arm extends downward on the front panel along the outer seam.

In some embodiments, the first arm of the stretch panel may converge to a tip at the end opposite the corner area. For example, the first arm may comprise a top edge and a bottom edge. The top edge may extend substantially horizontally across the front of the leg and the bottom edge may be angled upward (toward the top edge) so as to meet the top edge at the tip. Similarly, the second arm of the stretch panel may converge to a tip at the end opposite the corner area. For example, the second arm may comprise an outer edge and an inner edge. The outer edge may extend substantially vertically along the length of the leg and the inner edge may be angled toward the outer side of the leg (and toward the outer edge) so as to meet the outer edge at the tip. In some embodiments, the bottom edge of the first arm and the inner edge of the second arm form an angle that is between about 90 and about 110 degrees.

In some embodiments, each of the stretch panels comprises an upper tip on the front of the pant and a lower tip on the rear of the pant as well as a front edge and a rear edge. The stretch panel extends diagonally from an upper tip on the front of the leg to a lower tip on the back of the leg, often forming a shape resembling a pointed oval. The stretch panel is configured to be located at the thigh of a wearer. In some embodiments, this stretch panel has a maximum width between about 0.5 and about 2.5 inches.

Each of the leg portions may comprise a front panel and a rear panel. The front panel and the rear panel are adjoined by at least an outer seam, and usually by an outer seam and an inner seam. In some embodiments, the outer seam is split by the pointed oval stretch panel described above. Accordingly, the outer seam becomes two seams between the upper tip and the lower tip of the stretch panel, with the two seams being separated by the stretch panel. The two seams that make up the outer seam of the leg between the upper tip and the lower tip of the stretch panel coincide with the front edge and the rear edge of the stretch panel.

In some embodiments, the outer seam runs vertically along the side of the pant leg with the exception of where it is split by the stretch panel. In other words, other than where it meets the stretch panel, the outer seam may be a conventional seam such is found on standard work pants. In other embodiments, the outer seam may have an unconventional path above and/or below the stretch panel. For example, in some embodiments, the outer seam may run substantially vertically down the side of the leg in a standard manner and then curve toward the front of the pant in order to coincide with the upper tip of the stretch panel. Because the upper tip of the stretch panel is located frontward of the standard outer seam, this forms an extended back panel portion. Additionally, in some embodiments, the outer seam may run substantially vertically from the lower tip of the stretch panel to the bottom edge of the leg. Because the lower tip of the stretch panel is located rearward of the standard outer seam, an extended front panel portion is formed.

Each of the leg portions may comprise a front panel and a rear panel. The front panel and the rear panel are adjoined by at least an outer seam, and usually by an outer seam and an inner seam. In some embodiments, the one or more stretch panels located on each of the first leg portion and the second leg portion may each be located entirely on the rear panel of each leg portion. Accordingly, when viewed from the front, the pant may have the appearance of a conventional pant, such as a conventional work pant.

In some embodiments, the rear panels of each of the first leg portion and second leg portion may comprise a substantially diagonal seam, which separates each rear panel into an upper region and a lower region. Each substantially diagonal seam extends diagonally from a common point at or near a rear seam of the pant in a direction downward and outward to a point at or near the outer seam of the leg portion. The substantially diagonal seam may be used for the positioning of one or more stretch panels at or across one or more microsites on the seat of the pant.

In some embodiments, the substantially diagonal seam on the rear portion of the leg may define the bottom edge of a stretch panel. The top edge of the stretch panel may comprise a first portion and a second portion. The first portion of the stretch panel top edge may coincide with the seam of the pant waistband. The second portion of the stretch panel top edge may extend substantially diagonally in a downward and outward direction from the first portion, i.e. from a point at the seam of the pant waistband, to a point at the outer seam of the leg. In some embodiments, for example, the second portion of the stretch panel top edge may extend substantially downward from the waistband a distance before extending downward and outward toward the outer seam of the leg. The outer edge of the stretch panel may coincide with the outer seam of the leg and the inner edge of the stretch panel may coincide with the rear seam of the pant. In some embodiments, the seat of the pant may comprise substantially identical stretch panels on each of the first and second legs, with the stretch panels being symmetrically disposed about the rear seam of the pant.

In some embodiments, the substantially diagonal seam on the rear portion of the leg may define the top edge of a stretch panel. In some embodiments, for example, the top edge of a stretch panel may extend from the point at which the substantially diagonal seam meets the rear seam of the pant to an outer point located on the rear panel of the leg, downward and outward along the substantially diagonal seam. The point at the rear seam of the pant may, for example, be selected so that the stretch panel coincides with an identified microsite. The stretch panel may also comprise a bottom edge that extends from the outer point located on the rear panel of the leg to a point at the inner seam of the leg. For example, the bottom edge may run diagonally downward and inward from the outer point to the inner seam of the leg. The front edge of the stretch panel may coincide with the inner seam of the leg portion. In some embodiments, the seat of the pant may comprise substantially identical stretch panels on each of the first and second legs, with the stretch panels being symmetrically disposed about the rear seam of the pant.

In some embodiments, the stretch panel described in the above paragraph may be combined with additional stretch panels located on the rear panel of each leg. Each additional stretch panel may extend substantially vertically between a top edge that coincides with or is near to the bottom of the waistband and a bottom edge that coincides with or is near to the substantially diagonal seam. The additional stretch panel may be positioned on the rear panel of the leg, at or near the outer seam of the leg. For example, the front edge of the stretch panel may coincide with or be near to the outer seam of the leg portion. The back edge of the stretch panel may be located on the rear panel of the leg.

BRIEF DESCRIPTION OF THE DRAWINGS

A clear conception of the advantages and features of one or more embodiments will become more readily apparent by reference to the exemplary, and therefore non-limiting, embodiments illustrated in the drawings.

DETAILED DESCRIPTION

Figure 1A:
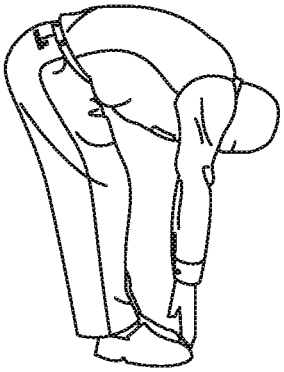
FIG. 1A is an illustration of the bending over movement, one of the five movements used to locate micro sites on embodiments of the pants described herein.

In order to provide a pant designed for a work uniform that provides a wearer with enhanced mobility, the present inventors have developed a number of embodiments. In some embodiments, the pant comprises a stretch panel. In other embodiments, the stitching of various elements of the pant have been newly developed.

In order to determine how to configure a pant designed for a work uniform so as to provide enhanced mobility, the present inventors used the process for designing garments responsive to the motions of a wearer that is generally described in U.S. patent application Ser. No. 14/066,501, the entirety of which is incorporated herein by reference as if fully set forth below. In brief, the process involves identifying corner usage patterns and usage positions by the garment wearer, attaching markers used in motion capture photography to the bare skin of a test subject, recording position and movement data of the test subject with a computer system while the test subject repeats the corner usage patterns and usage positions, processing the position and movement data to create an opportunity map which identifies stretch and compression areas of the bare skin of the test subject, attaching markers to a standard work garment worn by a test subject, recording garment construction data of the garment worn by the test subject while the test subject repeats the corner usage patterns and usage positions, analyzing garment construction data to create a problem map which identifies stretch and compression areas of the garment, creating a mobility map based on the opportunity map and problem map, and using the mobility map to create a pant design that reduces tension and restriction.

Although key body movements and positions may differ based upon the intended wearer of a pant (for example a carpenter may have one set of associated body movements while a bricklayer has a different associated set, while a mover has a different associated set), the process was applied over a set of five distinct movements in order to prepare the embodiments of the present invention. As illustrated in FIGS. 1A-1E, the five movements are (A) bending over, (B) squatting, (C) kneeling and twisting, (D) reaching forward and up, and (E) big step. These movements were selected because they were believed to be corner to a broad array of intended wearers in their respective workplaces. For example, these movements replicate those performed when picking up a box, getting into a truck, and putting an item on a shelf, among other things.

Using the mobility mapping process, a number of micro sites were identified. As defined in U.S. patent application Ser. No. 14/066,501, a "micro site" is generally an identified location on the garment for improved mobility over a predefined range of movements.

Using these micro sites, the inventors developed a number of unique new pant embodiments that provide significant improvements in a wearer's comfort, performance, and mobility when performing the array of movements described above.

A work pant 1 comprises at least a first leg portion 2, or first leg, and a second leg portion, or second leg. A work pant 1 also typically comprises a waistband 3 and a fastening mechanism 4 that may include, for example, buttons, zippers, snaps, and the like. A work pant 1 also typically comprises front pockets 5 and one or more rear pockets 6. In contrast to athletic gear, for instance, a work pant 1 is generally not form-fitting, i.e. it is not meant to conform to the body. Rather a work pant 1 is typically meant to have a substantially loose fit. Due to the different function that it serves, the material or materials used in constructing a work pant 1 are also generally very different from that used in constructing athletic gear.

In embodiments of the work pant 1, each leg 2 typically comprises a front panel 7 and a rear panel 8. The front panel 7 and the rear panel 8 are joined together by at least an outer seam 9, and more typically an outer seam 9 and an inner seam 10. The outer seam 9, as the name implies, is located on the outer-facing side of the leg and runs longitudinally along the outer length of the leg. The inner seam 10 is located on the inner-facing side of the leg and runs longitudinally along the inner length of the leg. In a standard work pant 1, the outer seam 9 and the inner seam can be considered to be the dividing lines between the front of the leg and the rear of the leg.

A work pant 1 also comprises a front seam 11 and a rear seam 12. The front seam 11 separates the front panel 7 of the first leg and the front panel 7 of the second leg. The front seam 11 is located above the leg inner seams 10 and runs vertically upward along the front of the pant to the waistband 3. The front seam 11 typically comprises a fly 13, which may be fastened during wear or opened for donning and doffing. The rear seam 12 separates the rear panel 8 of the first leg and the rear panel 8 of the second leg. The rear seam 12 is located above the leg inner seams 10 and runs vertically upward along the seat of the pant to the waistband 3. Typically, the rear seam 12 is centrally located on the seat of the pant. The inner seams 10 of each leg intersect the front seam 11 and the rear seam 12 at the crotch seam 15, which is located at the bottom of the crotch during wear.

In some embodiments of the present pant 1, the outer seam 9 may have an unconventional pathway. In those embodiments, the line that would be formed by a standard outer seam should still be understood by one of ordinary skill as the conceptual dividing line between the front of the leg and the rear of the leg. This may result in a front panel 7 that is partially present on the rear of the leg and/or a rear panel 8 that is partially present on the front of the leg.

The outer side of the leg should be understood as the portion of the leg that is visible when the pant is viewed from the side, such as in the side elevation views provided herein in certain drawings. The inner side of the leg should be understood as the portion of the leg that is opposite the outer side of the leg.

Embodiments of the pant 1 may be configured to be capable of withstanding laundering under conditions that are harsher than those used in home laundering processes. For example, in some embodiments, it may be important that the fabric or fabrics that make up the pant 1 are able to withstand industrial laundering. Many workers in a variety of fields obtain their work wear through a uniform rental program. The garments that are provided by uniform rental programs are washed by a process known as industrial laundering. Industrial laundering must meet a set of standards defined by ISO (the International Organization for Standardization) standards such as ISO 15797 and ISO 30023. For example, in contrast to home laundering processes, which typically take place at about 120° F., industrial laundering takes place at a temperature of at least 150-160° F. Industrial laundering also requires the use of stronger chemicals than those used in a home laundering process. Chemicals used in industrial laundering typically include strong alkali components and strong surfactants. Acids may also be used to bring the pH of a garment to a level that will not irritate the skin. Many industrial laundering processes also employ additional steps that include treatment with agents such as bleaches and/or antichlor compounds. As a result, fabrics that are not configured to withstand the more extreme conditions of industrial laundering may often be destroyed by the process. It is contemplated that embodiments of the pant 1 may be provided to workers through a uniform rental program. Accordingly, embodiments of the pant 1 may be configured to be capable of withstanding industrial laundering.

Embodiments of the pant 1 of the present invention comprise one or more stretch panels 20, 30, 70, 80, 90 that are configured to act at one or more micro sites to provide significant improvements in a wearer's comfort, performance, and mobility.

The one or more stretch panels 20, 30, 70, 80, 90 of embodiments of the present invention each comprise a material having an increased degree of stretchability over the material used in the remainder of the pant. The stretchability of a material may be defined by a fabric stretch percentage, which is calculated using the stretch and recovery method, standardized as ASTM D2594. The stretch panels of embodiments of the pants preferably have a fabric stretch percentage of at least about 2%, alternatively at least about 5%, alternatively at least about 10%, alternatively at least about 15%, alternatively at least about 20%, alternatively at least about 30%, and alternatively at least about 40%. In some embodiments, for example, the stretch panels may have a fabric stretch percentage between about 20% and about 30%, between about 30% and about 40%, or greater than 40%.

The stretchability may also be defined according to the direction in which stretching forces are applied. 2-way stretch fabrics stretch in one direction (e.g. either lengthwise or crosswise), while 4-way stretch fabrics stretch in both directions (lengthwise and crosswise). Embodiments of the stretch panels 20, 30, 70, 80, 90 described herein may comprise 2-way stretch, 4-way stretch, and combinations thereof. In some embodiments, the stretch panels comprise a 4-way stretch material, such as a 4-way stretch material having a fabric stretch percentage in both directions of at least about 2%, alternatively at least about 5%, alternatively at least about 10%, alternatively at least about 15%, alternatively at least about 20%, alternatively at least about 30%, and alternatively at least about 40%. In some embodiments, for example, the stretch panels may have a fabric stretch percentage in both directions that is between about 20% and about 30%, between about 30% and about 40%, or greater than 40%.

For example, in some embodiments, the stretchable fabric may comprise a blend of polyester, cotton, and spandex. The blend of polyester, cotton, and spandex may, for example, be specially configured to withstand industrial laundering. In view of the above disclosure, it is believed that a person of ordinary skill in the art would understand, and be able to select from, a variety of stretchable fabrics that could be used in the stretch panels 20, 30, 70, 80, 90 of embodiments presented herein.

The stretch panels 20, 30, 70, 80, 90 can be adjoined to the base material of the pant by conventional methods that would be understood by a person of skill in the art. For example, the stretch panels 20, 30, 70, 80, 90 can be adjoined to the base material of the pant by sewing. Any conventional stitching methods may be used, including but not limited to over stitch, under stitch, chain stich, lock stitch, flat stitch, and the like.

In some embodiments, the stretch panels 20, 30, 70, 80, 90 may be substantially concealed when not being subjected to a movement that causes it to stretch. For example, the pant 1 may comprise one or more flaps that cover the stretch panel 20, 30, 70, 80, 90 so that the stretch panel is substantially concealed when not being subjected to a movement that causes it to stretch. The flaps are desirably made of the base material of the pant 1 and may provide an additional protective element to the wearer in the area of the stretch panel 20, 30, 70, 80, 90.

In some embodiments, the one or more stretch panels 20, 30, 70, 80, 90 may also be configured to provide the pant with enhanced thermal management properties. For example, in some embodiments, the one or more stretch panels 20, 30, 70, 80, 90 may have a moisture-wicking property that is greater than the base material of the pant. And in some embodiments, the one or more stretch panels 20, 30, 70, 80, 90 may have an air permeability that is greater than the base material of the pant. When used in connection with clothing, air permeability it is often described as "breathability." The air permeability of a fabric is also closely related to its drying time. Accordingly, in some embodiments where the one or more stretch panels 20, 30, 70, 80, 90 are configured to provide both enhanced moisture-wicking properties and enhanced air permeability, the enhanced air permeability of the one or more stretch panels may assist in the drying of the moisture that is wicked to the outer face of the fabric, enhancing the moisture-wicking function of the fabric.

Additionally, although the invention is described herein as being directed to a pant 1, it should be understood that, in some embodiments, the pant 1 described herein may also be a segment of a full body uniform, such as a coverall. While some of the general components of a coverall bottom segment may take on a slightly different form from a stand-alone work pant 1, the mobility enhancing features of any of the stand-alone pants described herein could be equally applicable to the bottom segment of a coverall, as would be understood by a person of ordinary skill in the art. Accordingly, the term pant, as used herein, is not limited to stand-alone pants, but rather should be understood to include the pant-portion of a coverall, for example.

Figure 2C:
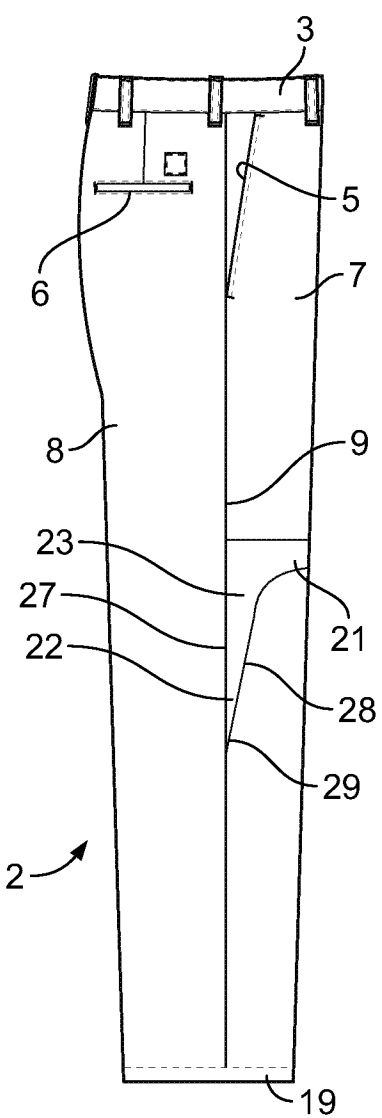
FIG. 2C is a side elevation view of an embodiment of a pant configured to provide a wearer with increased mobility.
Figure 2B:
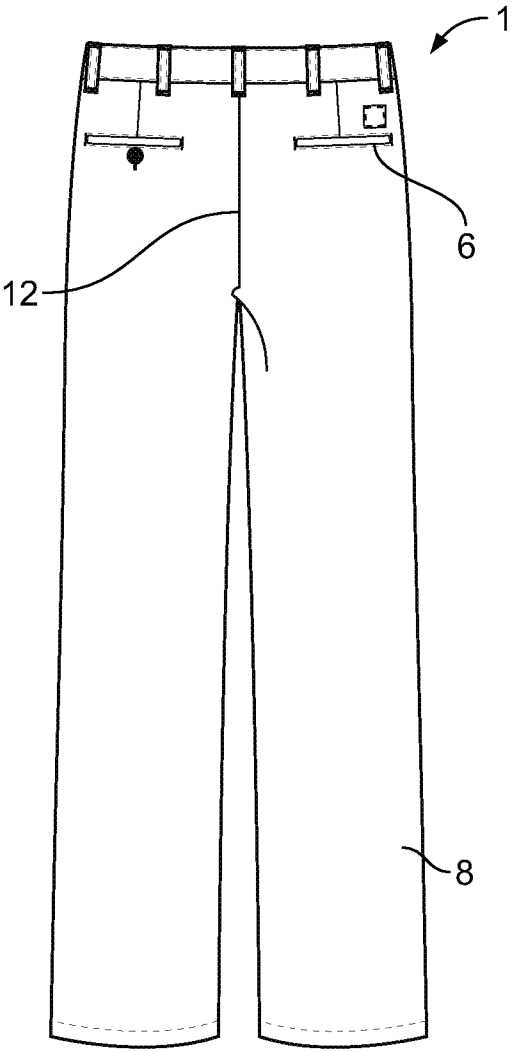
FIG. 2B is a rear elevation view of an embodiment of a pant configured to provide a wearer with increased mobility.
Figure 2A:
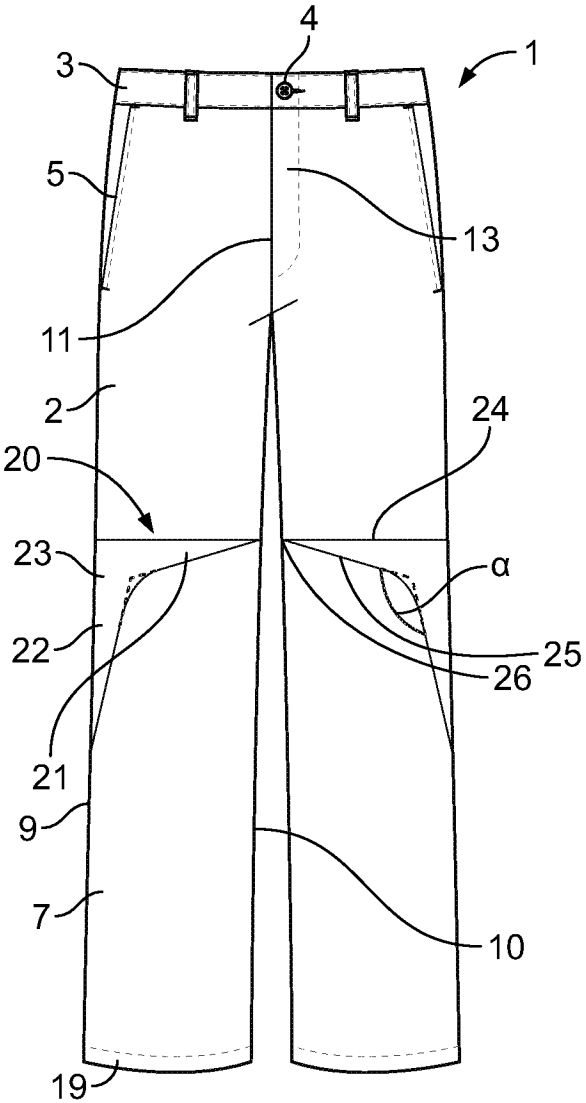
FIG. 2A is a front elevation view of an embodiment of a pant configured to provide a wearer with increased mobility.

An embodiment of the present invention is illustrated in FIGS. 2A through 2C. The embodiment illustrated in FIG. 2A through 2C comprises a first stretch panel 20 located at a micro-site of the first leg 2 and a second stretch panel located at a micro-site of the second leg. Each of the stretch panels 20 comprises a first arm 21 and a second arm 22. Each of the first arm 21 and the second arm 22 extend from and coincide at corner area 23. For purposes of describing the spans of each of the first arm 21 and the second arm 22, the corner area 23 may be considered to be both a part of the first arm 21 and a part of the second arm 22. The corner area 23 may be located at the outer side of the leg and preferably on the front panel 7 of the leg. For example, the corner area 23 may be on a portion of the front panel 7 and may border the outer seam 9.

The first arm 21 extends laterally across the front of the leg 2. The length of the first arm 21 may be selected, depending on the size and intended usage of the pant 1, to provide the desired amount of stretchability to the pant while at the same time minimizing the dimensions of the stretch panel 20 (and accordingly the amount of stretch material used in the garment). In some embodiments, such as that illustrated in FIG. 2A, the first arm 21 spans across the entirety of the front panel 7, such as from the corner area 23, which borders the outer seam 9, to the inner seam. For example, it may be preferable from a manufacturing perspective for the first arm 21 to contact the inner seam, thereby splitting the front of the pant leg into two portions. In other embodiments, the first arm 21 may not extend across the entirety of the front panel, but rather only a few inches from the corner area.

The first arm 21 is preferably configured so that it is slightly above a wearer's kneecap. For instance, the first arm 21 may be configured such that it is located less than 4 inches above a wearer's kneecap, alternatively less than 3 inches, and alternatively less than 2 inches. While the first arm 21 may align with the kneecap, this embodiment is less preferred because the seams connecting the stretch panel to the front of the leg can produce discomfort, especially when squatting or kneeling.

The first arm 21 comprises an upper edge 24 and a lower edge 25. In some embodiments, the first arm 21 converges to a tip 26 at the end opposite the corner area 23, i.e. the upper edge 24 and lower edge 25 come together to meet at a tip 26. For example, in some embodiments the first arm 21 continuously narrows as it moves toward an inner side of the leg where it terminates at the tip 26. This may occur, for example, where the upper edge 24 and the lower edge 25 are both angled toward one another. It may also occur where one of the upper edge 24 and the lower edge 25 runs substantially horizontally across the front of the leg 2 and the other one of the upper edge and the lower edge is angled so as to converge with the horizontal edge at a tip 26. For example, in some embodiments, the upper edge 24 of the first arm runs substantially horizontally across the front of the leg 2 and the lower edge 25 of the first arm is angled so as to approach the upper edge as the first arm 21 moves toward the inner side of the leg.

The maximum width of the first arm 21, i.e. the farthest distance across between the upper edge 24 and the lower edge 25 of the first arm, may be selected depending on the size and intended usage of the pant 1, to provide the desired amount of stretchability to the pant while at the same time minimizing the dimensions of the stretch panel 20 (and accordingly the amount of stretch material used in the garment). In some embodiments, the first arm 21 has a maximum width less than 5 inches, alternatively less than 3 inches. In some embodiments, the first arm has a maximum width between about 0.5 and about 3 inches, alternatively between about 0.5 and about 2.5 inches.

The second arm 22 extends longitudinally downward from the corner area 23. As with the corner area 23, the second arm 22 may be located at the outer side of the leg and preferably on the front panel 7 of the leg. For example, the second arm 22 may be on a portion of the front panel 7 and may border the outer seam 9.

The second arm 22 comprises an outer edge 27 and an inner edge 28. In some embodiments, the second arm 22 converges to a tip 29 at the end opposite the corner area 23, i.e. the inner edge 28 and the outer edge 27 come together meet at a tip 29. For example, in some embodiments the second arm 22 continuously narrows as it moves downward along the leg 2 until it terminates at the tip 29. This may occur, for example, where the inner edge 28 and the outer edge 27 are both angled toward one another. It may also occur where one of the inner edge 28 and the outer edge 27 runs substantially vertically down the leg 2 and the other one of the inner edge 28 and the outer edge 27 is angled so as to converge with the vertical edge at a tip 29. For example, in some embodiments, the outer edge 27 of the second arm runs substantially vertically down the leg 2, such as along the outer seam 9, and the inner edge 28 of the second arm is angled so as to approach the outer edge as the second arm 22 moves down the leg.

The maximum width of the second arm 22, i.e. the farthest distance across between the inner edge 28 and the outer edge 27 of the second arm, may be selected depending on the size and intended usage of the pant 1, to provide the desired amount of stretchability to the pant while at the same time minimizing the dimensions of the stretch panel 20 (and accordingly the amount of stretch material used in the garment). In some embodiments, the second arm 22 has a maximum width less than 5 inches, alternatively less than 3 inches. In some embodiments, the second arm has a maximum width between about 0.5 and about 3 inches, alternatively between about 0.5 and about 2.5 inches.

The length of the second arm 22 may also be selected, depending on the size and intended usage of the pant 1, to provide the desired amount of stretchability to the pant while at the same time minimizing the dimensions of the stretch panel 20 (and accordingly the amount of stretch material used in the garment). In some embodiments, the second arm 22 may only travel a short distance down the length of the leg 2. For example, in some embodiments, the second arm 22 spans a distance from the top of the corner 23 to a lowermost point that is between about 6 inches and about 20 inches, alternatively between about 7 inches and about 15 inches. One such embodiment is illustrated, for example, in FIGS. 2A through 2C.

Figure 3:
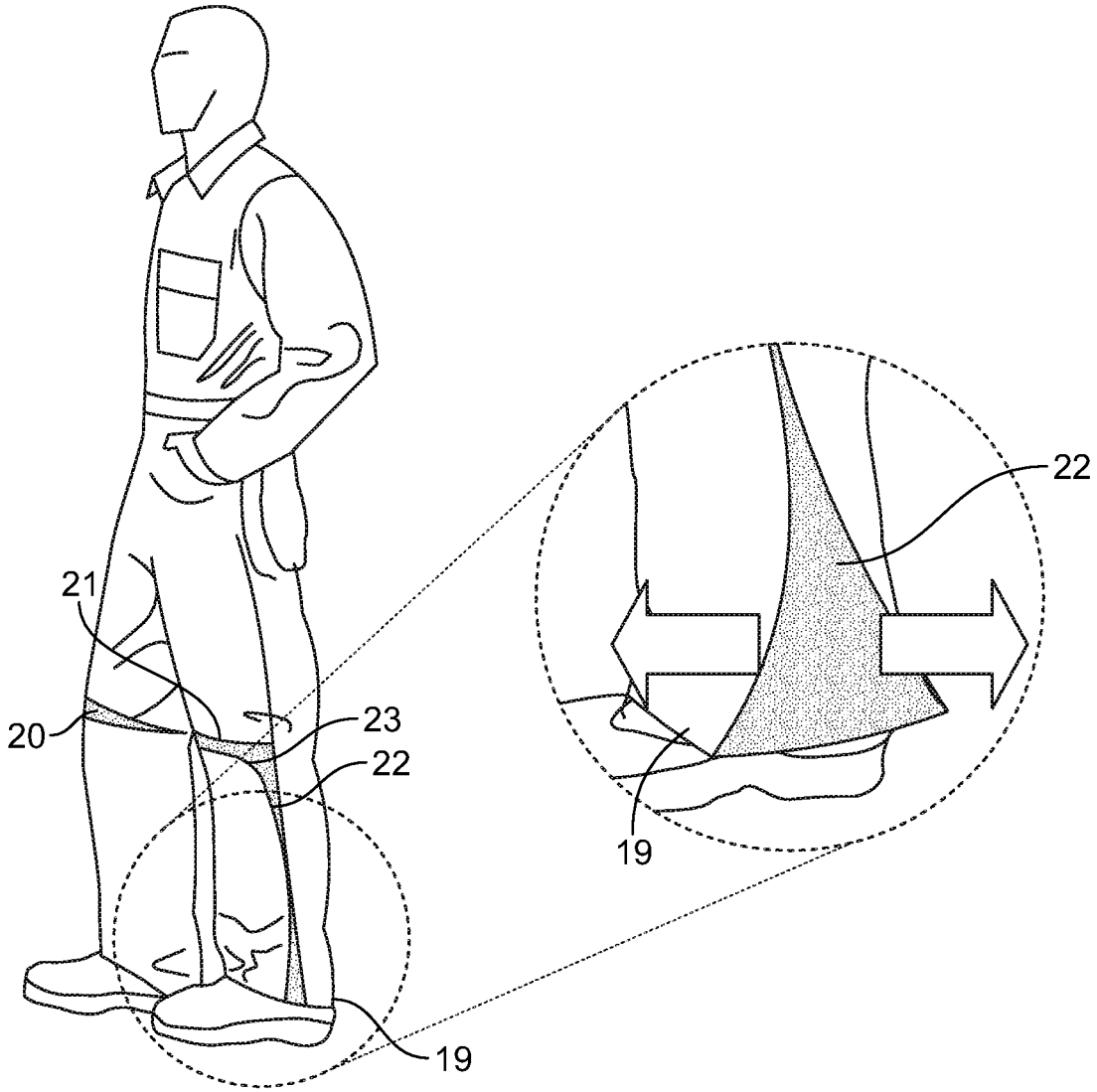
FIG. 3 is a perspective view of an embodiment of a pant configured to provide a wearer with increased mobility.
Figure 4A:
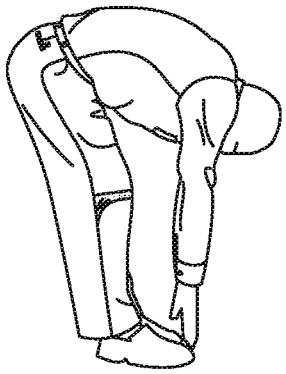
FIG. 4A is a perspective view of the embodiment shown in FIG. 2 providing a wearer with increased mobility when subjected to the bending over movement.
Figure 4B:
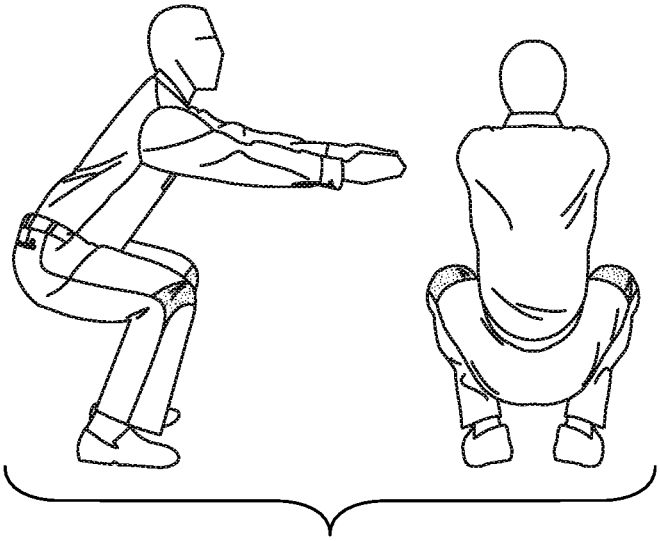
FIG. 4B is a perspective view of the embodiment shown in FIG. 2 providing a wearer with increased mobility when subjected to the squatting movement.
Figure 4C:
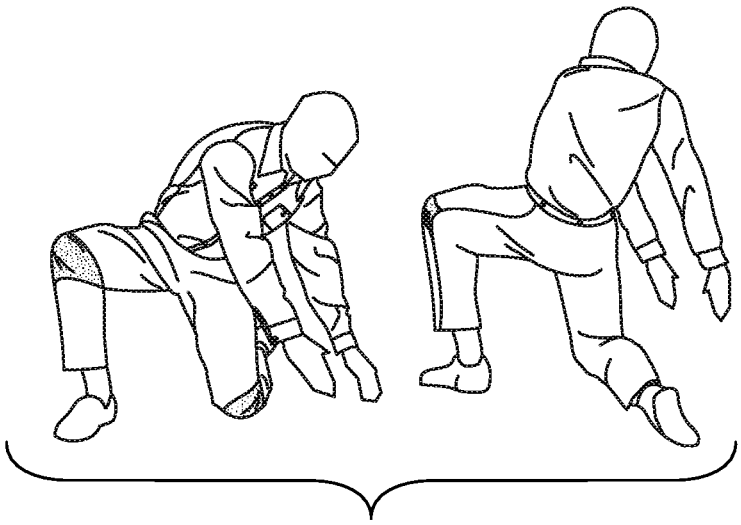
FIG. 4C is a perspective view of the embodiment shown in FIG. 2 providing a wearer with increased mobility when subjected to the kneeling and twisting movement.
Figure 4D:
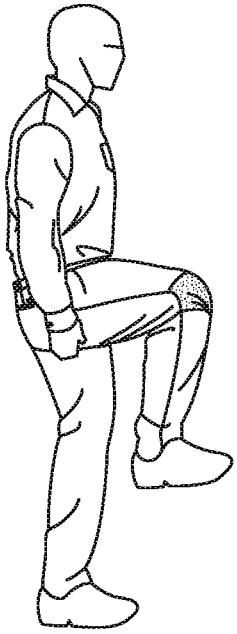
FIG. 4D is a perspective view of the embodiment shown in FIG. 2 providing a wearer with increased mobility when subjected to the big step movement.

In other embodiments, such as that illustrated in FIG. 3, the second arm 22 may extend further down the length of the leg 2. For example, the second arm 22 may extend all the way to the bottom edge 19 of the leg. In some embodiments, the second arm 22 of the stretch panel 20 may widen or flare outward at or near the bottom edge of the leg 19. While having little additional effect on the mobility of the wearer across the described range of motions, this embodiment may provide the additional benefit of stretchability of the pant leg 2 at and around boots, such as work boots.

The intersections of the first arm 21 and the second arm 22 at the corner area 23 may be sharp or rounded. For example, in some embodiments, the lower edge 25 of the first arm may form a point with the inner edge 28 of the second arm. Alternatively, the lower edge 25 of the first arm may curve downward and the inner edge 28 of the second arm may curve inward, such that the intersection is rounded. In some embodiments, the lower edge 25 of the first arm and the inner edge 28 of the second arm may form an angle $\alpha$ that is between about 90 and about 120 degrees, alternatively between about 90 and about 110 degrees, alternatively between about 95 and about 105 degrees. Where the intersection is rounded, as described above, the angle $\alpha$ may be measured by conceptually extending each of the edges 25, 28 to form a sharp angle, as would be understood by one of ordinary skill in the art.

The stretching of an embodiment such as described above in response to the motions applied to the mobility mapping process is shown in FIGS. 4A through 4D. The embodiment illustrated comprises a stretch panel 20 having a first arm 21 that extends laterally across the front of the leg 2 and a second arm 22 that extends downward at the outer side of the leg. As a wearer performs the range of motions, the stretch panel 20 provides for stretching of the pant 1 at the identified micro sites in order to provide significant improvements in a wearer's comfort, performance, and mobility.

Figure 5C:
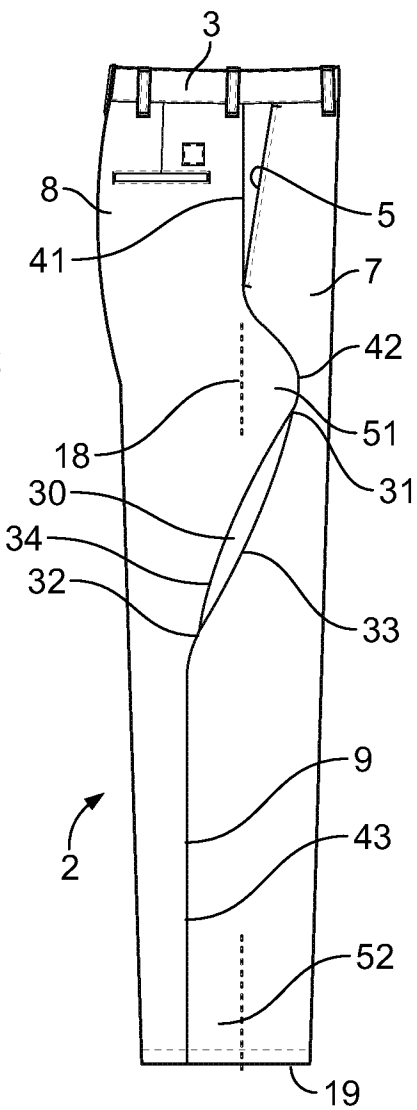
FIG. 5C is a side elevation view of an embodiment of a pant configured to provide a wearer with increased mobility.
Figure 5B:
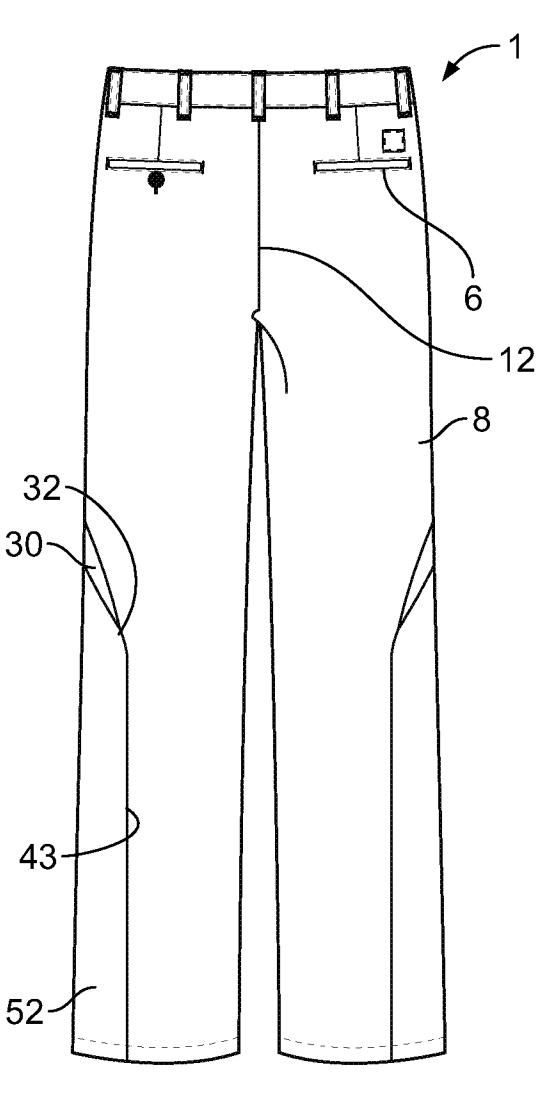
FIG. 5B is a rear elevation view of an embodiment of a pant configured to provide a wearer with increased mobility.
Figure 5A:
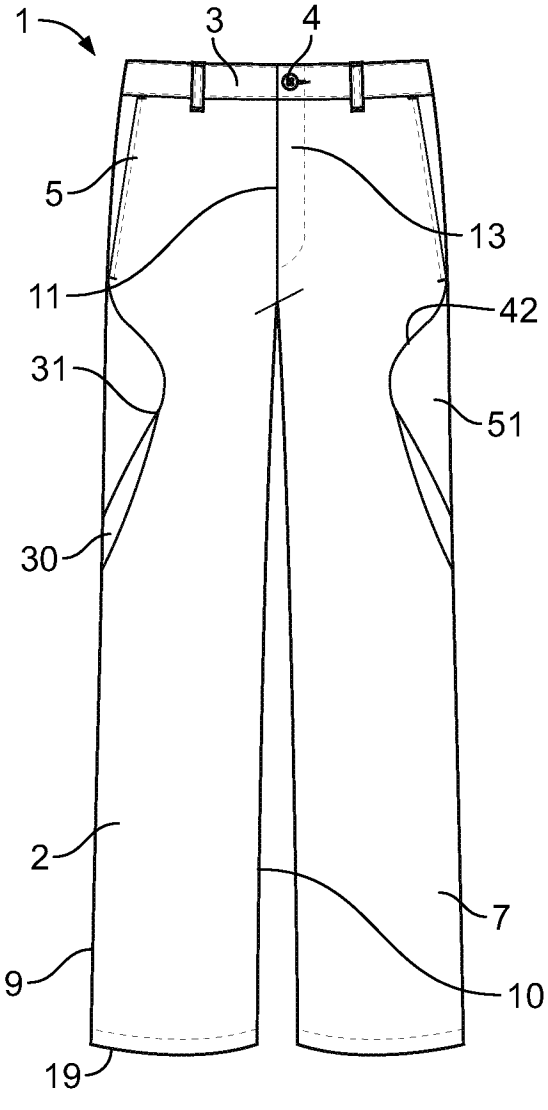
FIG. 5A is a front elevation view of an embodiment of a pant configured to provide a wearer with increased mobility.
Figure 6A:
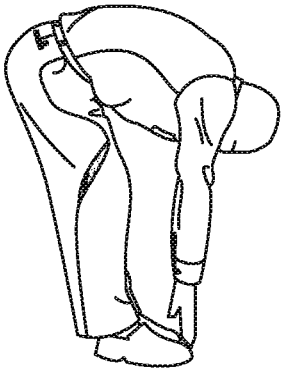
FIG. 6A is a perspective view of the embodiment shown in FIG. 5 providing a wearer with increased mobility when subjected to the bending over movement.
Figure 6B:
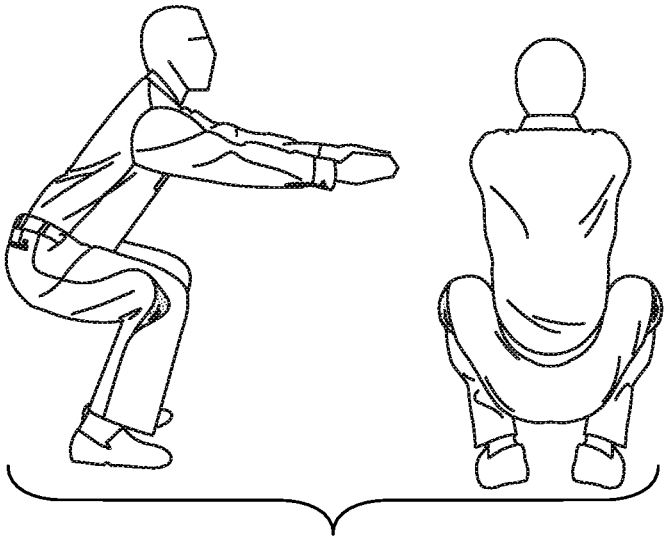
FIG. 6B is a perspective view of the embodiment shown in FIG. 5 providing a wearer with increased mobility when subjected to the squatting movement.
Figure 6C:
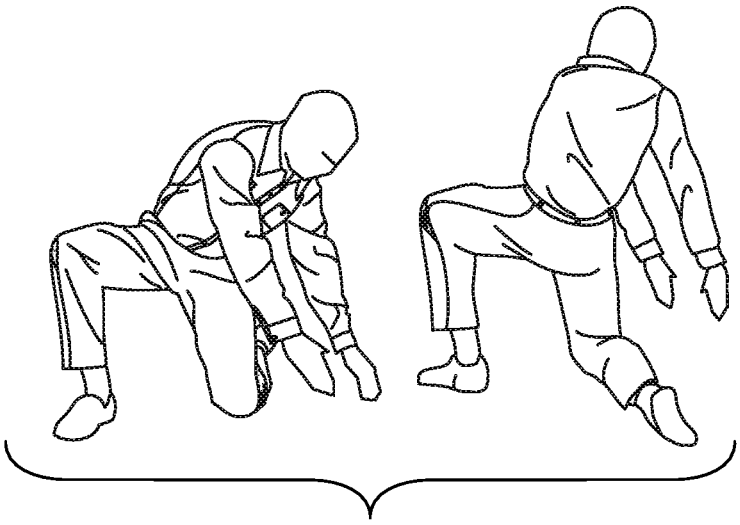
FIG. 6C is a perspective view of the embodiment shown in FIG. 5 providing a wearer with increased mobility when subjected to the kneeling and twisting movement.
Figure 6D:
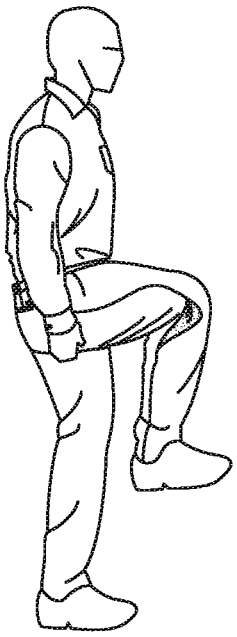
FIG. 6D is a perspective view of the embodiment shown in FIG. 5 providing a wearer with increased mobility when subjected to the big step movement.

Another embodiment of the present invention is illustrated in FIGS. 5A through 5C. The embodiment illustrated in FIGS. 5A through 5C comprises a first stretch panel 30 located at a micro-site of the first leg 2 and a second stretch panel located at a micro-site of the second leg. Each of the stretch panels 30 is configured to extend from an upper tip 31 on the front of the leg (see FIG. 5A) to a lower tip 32 on the rear of the leg (see FIG. 5B). As noted above, the front of the leg and the rear of the leg can be separated by a standard side seam, or if the pant 1 does not comprise a standard side seam, by a dividing line contemplated to have the same location as a standard side seam (such as is illustrated as reference 18 in FIG. 5C).

The stretch panel 30 also comprises a forward edge 33 and a rearward edge 34, each of which spans from the upper tip 31 to the lower tip 32. The forward edge 33 and the rearward edge 34 preferably diverge from one another when moving from the upper tip 31 toward a substantially central point and when moving from the lower tip 32 toward a substantially central point. The forward 33 and rearward 34 edges are thus preferably spaced apart from one another by a maximum distance located at a portion of the stretch panel 30 that is substantially midway between the upper tip 31 and the lower tip 32. In this embodiment, the stretch panel 30 may take on the shape of a pointed oval.

The maximum width of each stretch panel 30, i.e. the farthest distance across between the forward edge 33 and the rearward 34 edge, may be selected depending on the size and intended usage of the pant 1, to provide the desired amount of stretchability to the pant while at the same time minimizing the dimensions of the stretch panel 30 (and accordingly the amount of stretch material used in the garment). In some embodiments, the stretch panel 30 has a maximum width less than 5 inches, alternatively less than 3 inches. In some embodiments, the stretch panel has a maximum width between about 0.5 and about 3 inches, alternatively between about 0.5 and about 2.5 inches.

The stretch panel is configured to be located at the thigh of a wearer. For example, the upper tip 31 may be configured to be between about 4 inches and about 15 inches below the waistband, or slightly below the pocket where the pant comprises pockets. The lower tip 32 is preferably configured to align with or be slightly above the kneecap of the wearer.

The length of each stretch panel 30 may also be selected, depending on the size and intended usage of the pant 1, to provide the desired amount of stretchability to the pant while at the same time minimizing the dimensions of the stretch panel 30 (and accordingly the amount of stretch material used in the garment). In some embodiments, each stretch panel 30 has a length between about 4 and about 15 inches, alternatively between about 5 and about 13 inches, alternatively between about 6 and about 12 inches.

In some embodiments, each leg 2 comprises a front panel 7 and a rear panel 8. The front panel 7 and the rear panel 8 are adjoined, such as by sewing, at an outer seam 9 and an inner seam. In some embodiments, the outer seam 9 runs vertically from the bottom edge 19 of the leg up to the waistband 3, as in a standard pant, with the exception of where it contacts the stretch panel 30.

In other embodiments, the outer seam 9 may be reconfigured to provide for additional mobility enhancements. For example, the embodiment illustrated in FIGS. 5A through 5C comprises an outer seam 9 that is split between the upper tip 31 and the lower tip 32 of the stretch panel 30. In this way, the stretch panel 30 provides stretchability along a portion of the outer seam 9. In some embodiments, the outer seam 9 may run substantially vertically down the side of the leg for a portion 41 above the stretch panel 30. For instance, the outer seam 9 may run vertically from the top of the leg, e.g. from the waistband 3, to at least the point where a front pocket 5 either contacts or abuts the outer seam. The outer seam 9 may then curve toward the front of the pant leg for a portion 42 in order to coincide with the upper tip 31 of the stretch panel. The curving forward of the outer seam 9 creates an extended rear panel portion 51. In other words, a portion of the rear panel 51 extends into the front of the pant leg.

The outer seam 9 may also run vertically or substantially vertically down the side of the leg for a portion 43 below the stretch panel 30. For instance, the outer seam 9 may span substantially vertically from at or near the lower tip 32 of the stretch panel 30 to the bottom edge of the leg 19. Because the lower tip 32 of the stretch panel is located on the rear of the leg, this portion 43 of the outer seam will be located on the rear of the pant leg, i.e. rearward of the dividing line contemplated align with a standard side seam 18. The vertical or substantially vertical span of portion 43 creates an extended front panel portion 52. In other words, a portion of the front panel 52 extends into the rear of the pant leg.

The stretching of an embodiment such as described above in response to the motions applied to the mobility mapping process is shown in FIGS. 6A through 6D. The embodiment illustrated comprises a stretch panel 30 spanning between an upper tip 31 on the front of the pant leg to a lower tip 32 on the rear of the pant leg. As a wearer performs the range of motions, the stretch panel 30 provides for stretching of the pant 1 at the identified micro sites in order to provide significant improvements in a wearer's comfort, performance, and mobility.

In some embodiments of the present pant 1, the rear panel 8 of each leg 2 may be divided between an upper portion 16 and a lower portion 17 by a substantially diagonal seam 60. The substantially diagonal seam 60 extends from a point 61 at which the substantially diagonal seam 60 intersects the rear seam of the pant 12 to a point 62 at which the substantially diagonal seam intersects the outer seam 9 of the leg. Generally, the point 61 at which the substantially diagonal seam 60 intersects the rear seam 12 is located at a point that is higher up on the pant 1 than the point 62 at which the substantially diagonal seam intersects the outer seam 9 of the leg. Accordingly, the substantially diagonal seam 60 can be said to extend from point 61 downward and outward to point 62.

The inclusion of a substantially diagonal seam 60 provides for the placement of stretch panels 70, 80, 90 that provide enhanced mobility, particularly with respect to one or more microsites located on the seat of the pant and/or in the crotch region. It also provides for the inclusion of stretch panels 70, 80, 90 that balance mobility with durability, the stretch panels being configured to provide for an enhancement in mobility without a deterioration of pant durability.

Y-Embodiment

Figure 7:
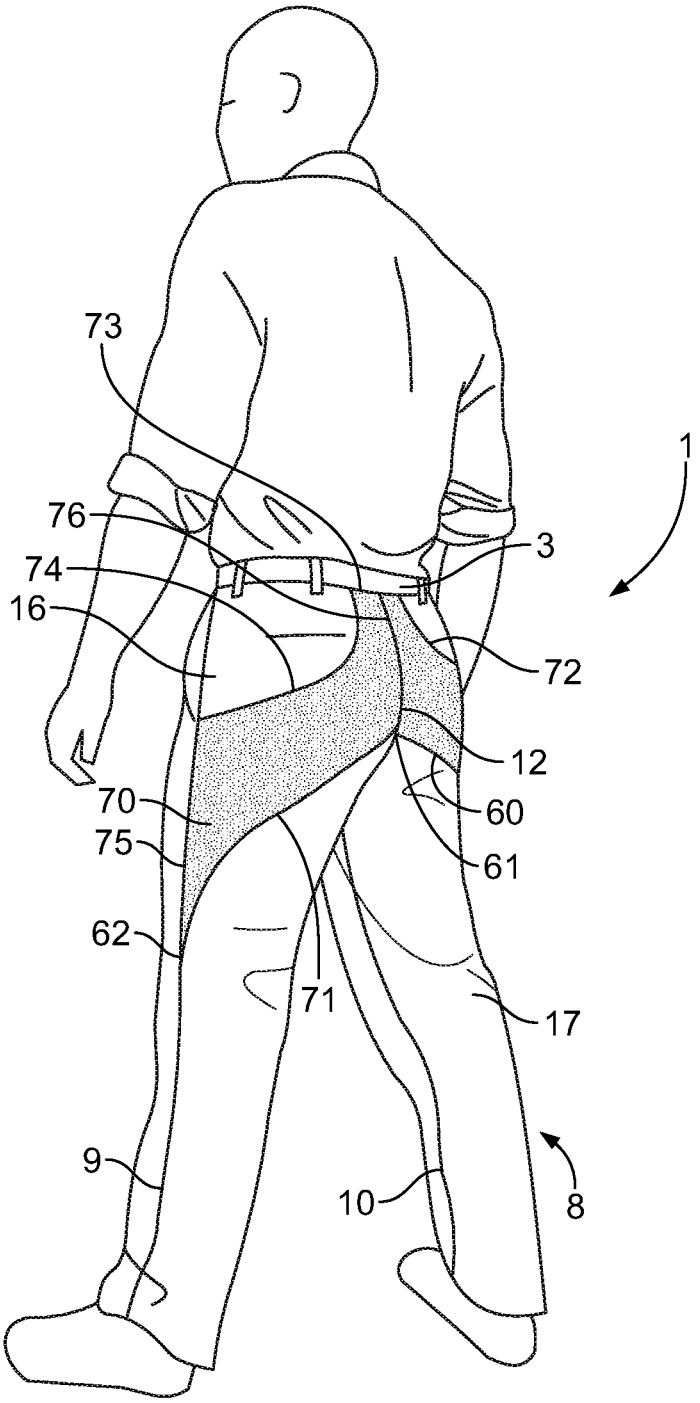
FIG. 7 is a rear perspective view of an embodiment of a pant configured to provide to provide a wearer with increased mobility.
Figure 8C:
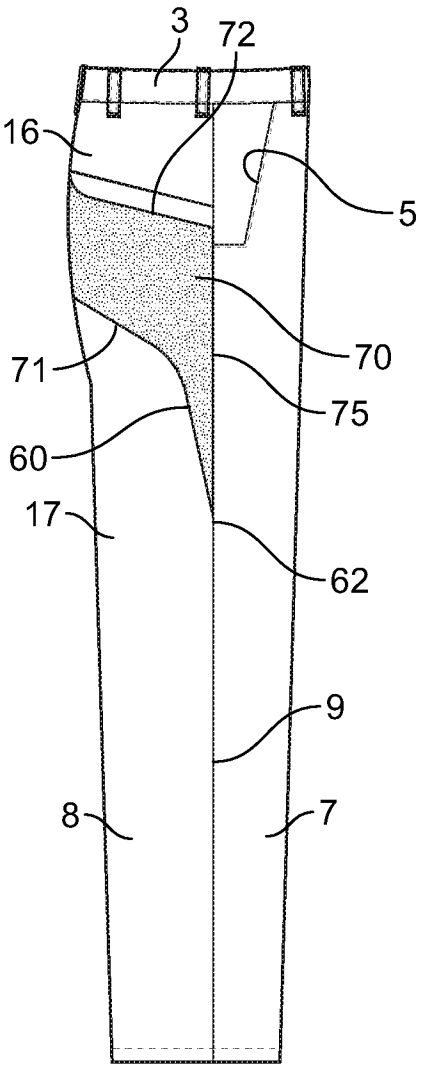
FIG. 8C is a side elevation view of an embodiment of a pant configured to provide a wearer with increased mobility.
Figure 8B:
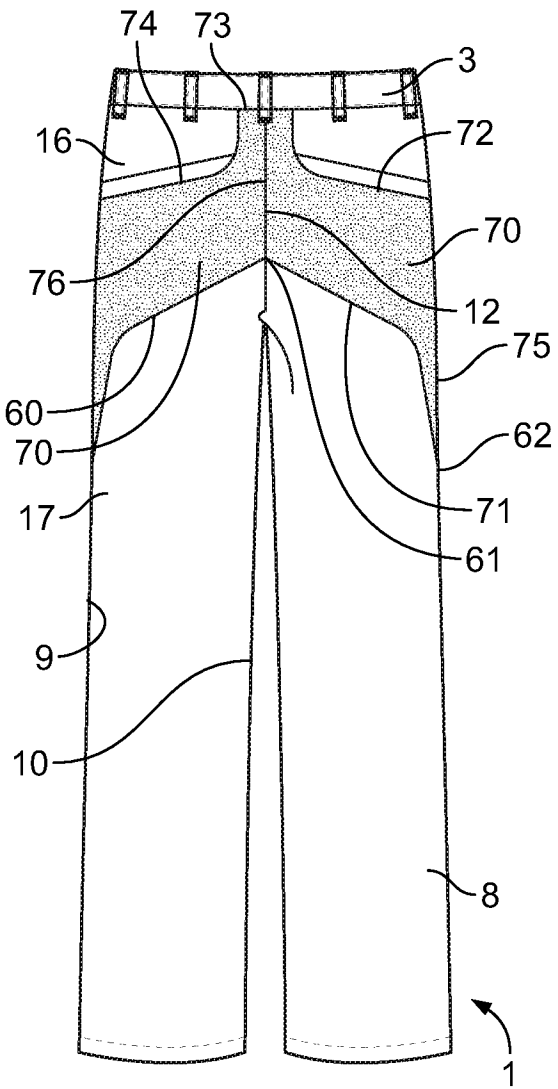
FIG. 8B is a rear elevation view of an embodiment of a pant configured to provide a wearer with increased mobility.
Figure 8A:
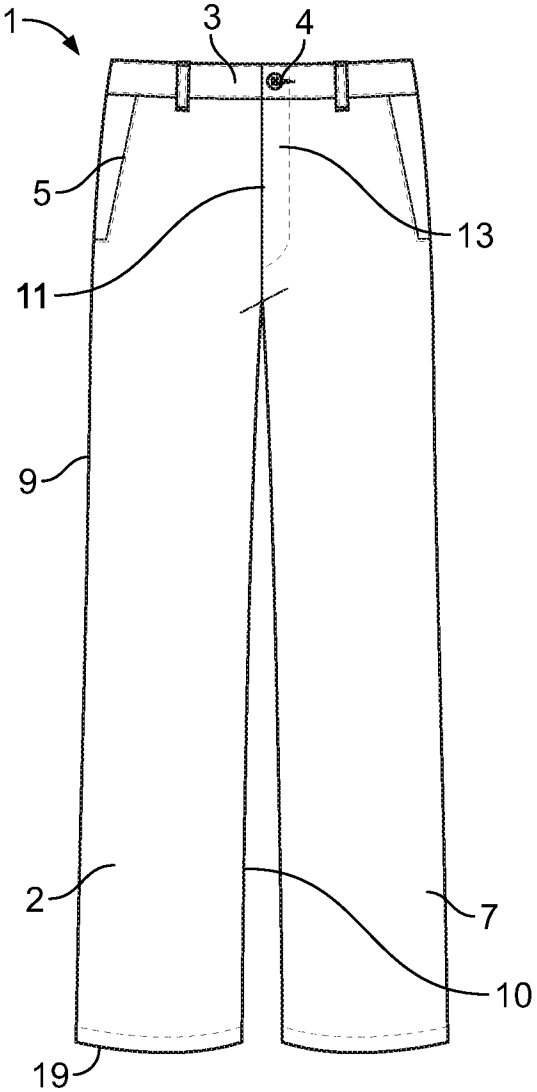
FIG. 8A is a front elevation view of an embodiment of a pant configured to provide a wearer with increased mobility.
Figure 9A:
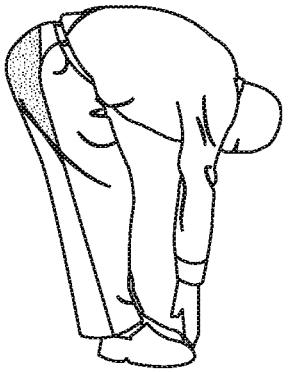
FIG. 9A is a perspective view of the embodiment shown in FIGS. 7 and 8 providing a wearer with increased mobility when subjected to the bending over movement.
Figure 9B:
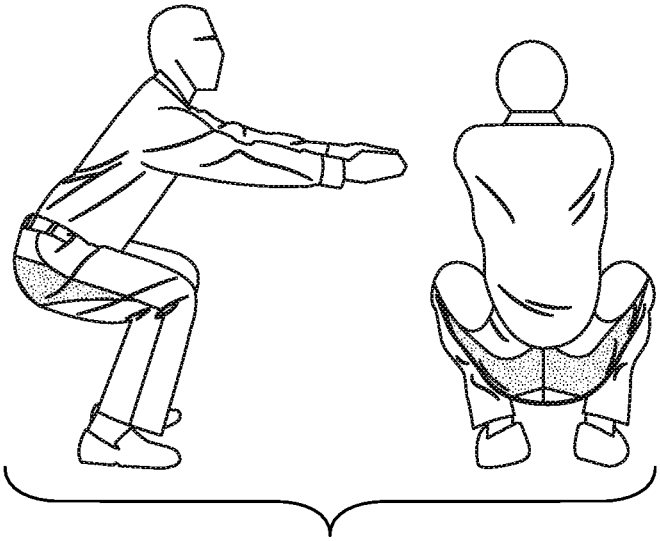
FIG. 9B is a perspective view of the embodiment shown in FIGS. 7 and 8 providing a wearer with increased mobility when subjected to the squatting movement.
Figure 9C:
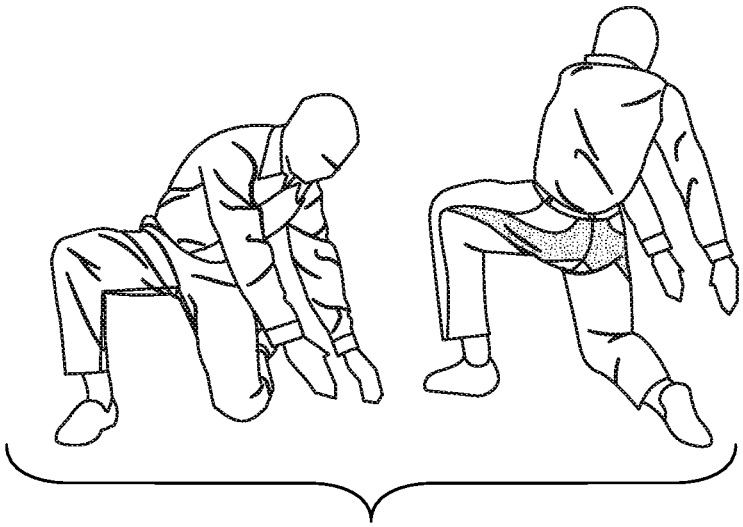
FIG. 9C is a perspective view of the embodiment shown in FIGS. 7 and 8 providing a wearer with increased mobility when subjected to the kneeling and twisting movement.
Figure 9D:
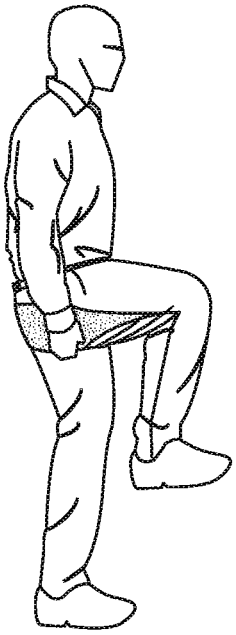
FIG. 9D is a perspective view of the embodiment shown in FIGS. 7 and 8 providing a wearer with increased mobility when subjected to the big step movement.

An embodiment of the present invention is illustrated in FIGS. 7 through 9. The embodiment illustrated in FIG. 7 through 9 comprises a first stretch panel 70 located at a micro-site of the first leg 2 and a second stretch panel located at a micro-site of the second leg. Each of the stretch panels 70 is configured to extend upward from a bottom edge 71 that coincides with the substantially diagonal seam 60. Accordingly, stretch panels 70 are located entirely on the upper portions 16 of the rear panels 8 of the legs. In some embodiments, the bottom edge 71 of each stretch panel 70 is configured to coincide with the substantially diagonal seam 60 along its entire length. In other words, the bottom edge 71 of the stretch panel 70 may be configured to span from point 61 (at which the substantially diagonal seam 60 intersects the rear seam of the pant 12) downward and outward to point 62 (at which the substantially diagonal seam intersects the outer seam of the leg 9).

The location of point 61, e.g. the distance of point 61 from the bottom of the waistband 3, may vary widely depending on the size of the pants. In some embodiments, for example, point 61 may be positioned between about 4 inches and about 19 inches below the bottom of the waistband 3, as measured from the point at which the rear seam 12 intersects the waistband. Alternatively, the point 61 may be positioned between about 4 inches and about 15 inches below the bottom of the waistband 3, alternatively between about 5 inches and about 12 inches below the bottom of the waistband, alternatively between about 5 inches and about 10 inches below the bottom of the waistband, alternatively between about 6 inches and about 9 inches below the bottom of the waistband.

Similarly, the location of point 62, e.g. the distance of point 62 from the bottom of the waistband 3, may vary widely depending on the size of the pants. In some embodiments, for example, point 62 may be positioned between about 10 inches and about 25 inches below the bottom of the waistband 3, as measured from the point at which the outer seam of the leg 9 intersects the waistband. Alternatively, the point 62 may be positioned between about 11 inches and about 24 inches below the bottom of the waistband 3, alternatively between about 12 inches and about 24 inches below the bottom of the waistband, alternatively between about 13 inches and about 23 inches below the bottom of the waistband, alternatively between about 15 inches and about 23 inches, alternatively between about 16 inches and about 22 inches.

In some embodiments, the substantially diagonal seam 60, and hence the bottom edge 71 of stretch panel 70, may not form a straight line. For example, as shown in the embodiment illustrated in FIGS. 7-9, the bottom edge 71 of stretch panel 70 may curve downward as it approaches the outer seam 9 of the leg. This configuration provides that a portion of the stretch panel 70 extends an additional distance down the outer thigh and is designed to provide for additional mobility across one or more microsites located in the region of the outer thigh. In other embodiments, this additional portion of stretch panel may be removed, e.g. by the bottom edge 71 of the stretch panel continuing in a more straight line as it approaches the outer seam 9. Additionally, in other (non-illustrated) embodiments the substantially diagonal seam, and hence the bottom edge 71 of stretch panel 70 may be either more straight or less straight than the embodiment illustrated in FIGS. 7-9, and may curve or bend in an either downward or upward direction.

The top edge 72 of the stretch panel 70 extends between the rear seam of the pant 12 and the outer seam of the leg 9. In some embodiments, such as the embodiment illustrated in FIGS. 7-9, the top edge 72 of the stretch panel 70 may comprise a first edge portion 73 and a second edge portion 74.

The first edge portion 73 may coincide with the bottom of the waistband 3, i.e. with the seam that is used to attach the waistband. The length of the first edge portion 73 may vary widely depending on the size of the pants. For example, the first edge portion 73 may extend from the rear seam of the pant 12 laterally outward, coinciding with the bottom of the waistband, for a distance between about 0.5 inch and about 8 inches, alternatively between about 1 inch and about 6 inches, alternatively between about 1 inch and about 5 inches, alternatively between about 1 inch and about 4 inches.

The second edge portion 74 may extend substantially diagonally from the end of the first edge portion 73 downward and outward until it intersects with the outer seam 9 of the leg. The location at which the second edge portion 74 intersects the outer seam 9 of the pant may vary widely depending on the size of the pants. For example, the point at which the second edge portion 74 intersects with the outer seam 9 of the leg may be between about 2 inches and about 14 inches below the bottom of the waistband 3, as measured from the point at which the outer seam intersects the waistband. Alternatively, the point at which the second edge portion 74 intersects with the outer seam 9 of the leg may be between about 3 inches and about 12 inches below the bottom of the waistband, alternatively between about 3 inches and about 10 inches below the bottom of the waistband, alternatively between about 4 inches and about 8 inches below the bottom of the waistband.

In some embodiments, the substantially diagonal second portion 74 of the top edge 72 of the stretch panel 70 may not form a straight line. For example, as shown in the embodiment illustrated in FIGS. 7-9, the second portion 74 of the stretch panel top edge 72 may extend substantially downward from the waistband a distance before curving outward in order to extend downward and outward to the outer seam 9 of the leg. In other (non-illustrated) embodiments, the second portion 74 of the stretch panel top edge 72 may be either straighter or more curved than the embodiment illustrated in FIGS. 7-9, and may curve or bend in an either downward or upward direction.

In an alternative (non-illustrated) embodiment, the top edge 72 of stretch panel 70 may not comprise a first edge portion 73 and a second edge portion 74, as described above. Rather, the top edge 72 may simply extend downward and outward from the rear seam of the pant 12 to the outer seam of the leg 9. For example, the top edge 72 may extend from the rear seam of the pant 12 at the point where the rear seam of the pant intersects the bottom of the waistband 3. Alternatively, the top edge 72 may extend from a point at the rear seam of the pant 12 that is just below the waistband 3, for example a point that is within about two inches, or within about one inch, from the bottom of the waistband.

The width of the stretch panel 70, i.e. the distance between the top edge 72 (particularly the second portion 74 of the top edge in the illustrated embodiment) and the bottom edge 71 of the stretch panel, may be selected depending on the size and intended usage of the pant 1, to provide the desired amount of stretchability to the pant while at the same time minimizing the dimensions of the stretch panel 70 (and accordingly the amount of stretch material used in the garment). Although the width of the stretch panel 70 may vary depending on the point at which the measurement is taken, the width at the center back of the leg (i.e. midway between the rear seam of the pant 12 and the outer seam of the leg 9) may be used as a general indicator. In some embodiments, for example, the width of the stretch panel 70 at the center back of the leg may be between about 2 inches and about 12 inches, alternatively between about 3 inches and about 10 inches, alternatively between about 4 inches and about 8 inches.

The stretch panel 70 also comprises an outer edge 75 and an inner edge 76. The outer edge 75 of the stretch panel preferably coincides with the outer seam 9 of the leg. In general, the length of the outer edge 75 may vary widely depending on the size of the pant. The length of the outer edge 75 may also be selected depending on the size and intended usage of the pant to provide the desired amount of stretchability while at the same time minimizing the dimensions of the stretch panel 70 (and accordingly the amount of stretch material used in the garment). For example, the outer edge 75 of the extend a vertical distance that is between about 5 inches and about 24 inches, alternatively between about 6 inches and about 20 inches, alternatively between about 8 inches and about 16 inches, alternatively between about 10 inches and about 14 inches.

The inner edge 76 of the stretch panel preferably coincides with the rear seam 12 of the pant. In general, the length of the outer edge 75 may vary widely depending on the size of the pant. The length of the outer edge 75 may also be selected depending on the size and intended usage of the pant to provide the desired amount of stretchability while at the same time minimizing the dimensions of the stretch panel 70 (and accordingly the amount of stretch material used in the garment). For example, the inner edge 76 of the stretch panel may extend a vertical distance that is between about 3 inches and about 15 inches, alternatively between about 4 and about 12 inches, alternatively between about 5 inches and about 10 inches.

Where the seat of the pant comprises substantially identical stretch panels 70 on each of the first and second legs, as is shown in the embodiments illustrated in FIGS. 7-9 for example, the stretch panels 70 may form the shape of an upside-down Y that is centrally located on the seat of the pant. The stretch panels 70 may be configured so that they are entirely positioned on the rear panels 8 of the leg portions. The front panels 7 of the leg portions may be configured to contain no stretch panels and may have an appearance that is identical with conventional pants.

Where the seat of the pant comprises substantially identical stretch panels 70 on each of the first and second legs, as is shown in the embodiments illustrated in FIGS. 7-9 for example, the stretch panels 70 provide for enhanced mobility over the range of movements described herein, and particularly for the squatting and big step movements. The stretching of an embodiment such as described above in response to the motions that were used during the mobility mapping process is shown in FIGS. 9A through 9D. The embodiment illustrated comprises a pair of stretch panels 70 positioned on the seat of the pant. As a wearer performs the range of motions, the stretch panels 70 provide for stretching of the pant 1 at the identified micro sites in order to provide significant improvements in a wearer's comfort, performance, and mobility.

X-Embodiment

Figure 10:
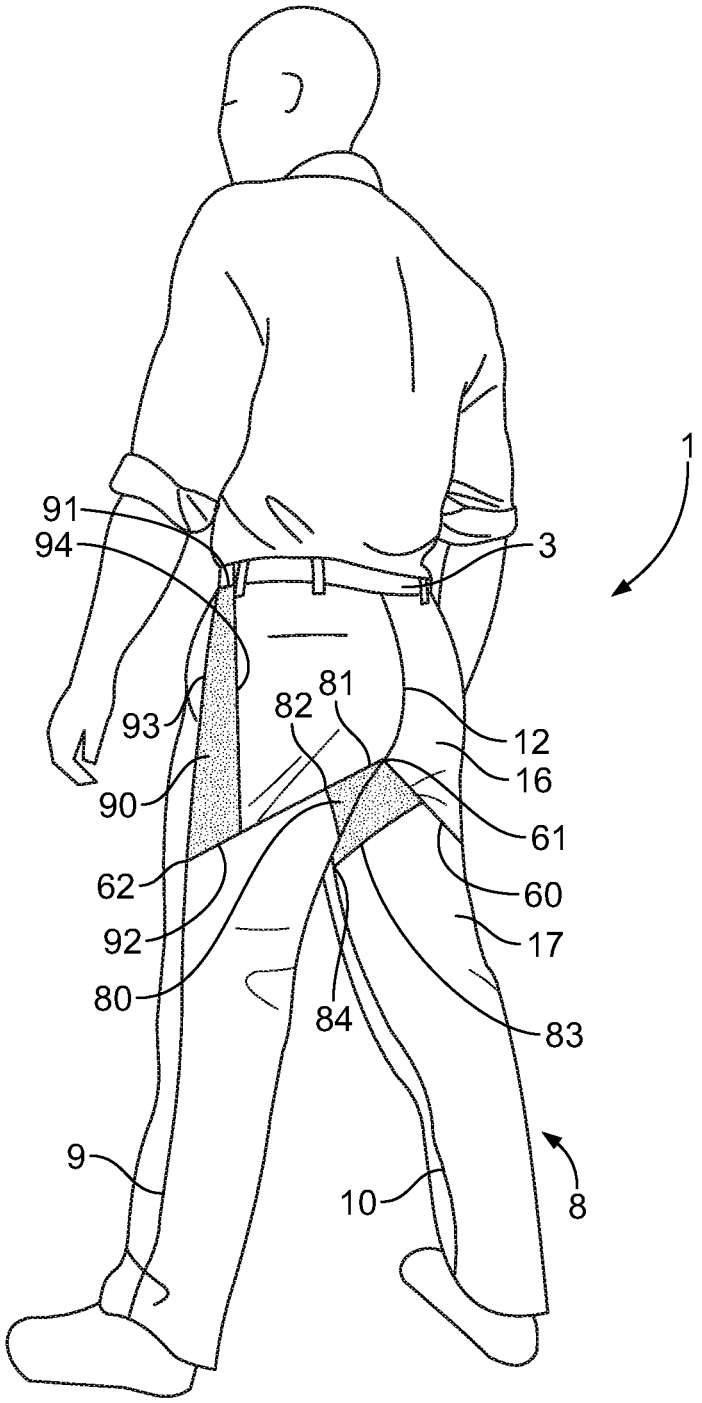
FIG. 10 is a rear perspective view of an embodiment of a pant configured to provide to provide a wearer with increased mobility.
Figure 11C:
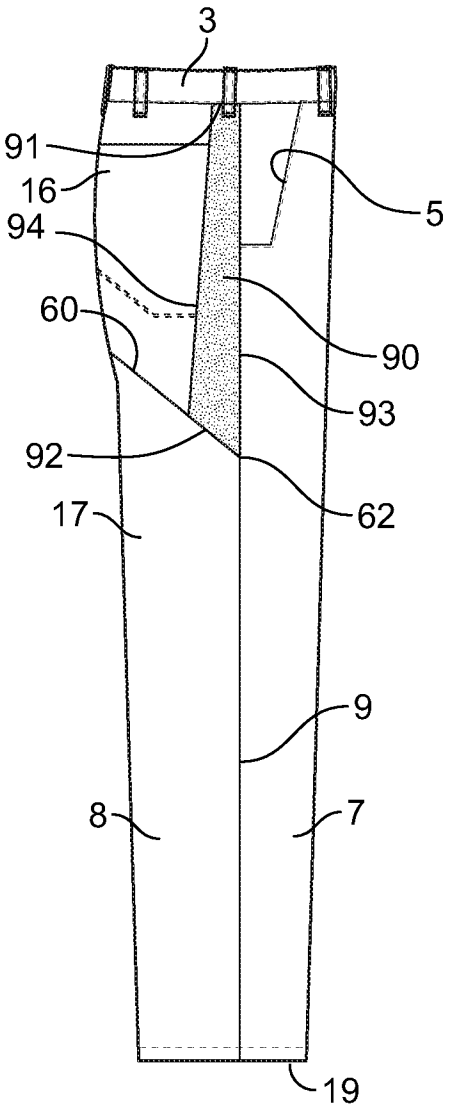
FIG. 11C is a side elevation view of an embodiment of a pant configured to provide a wearer with increased mobility.
Figure 11B:
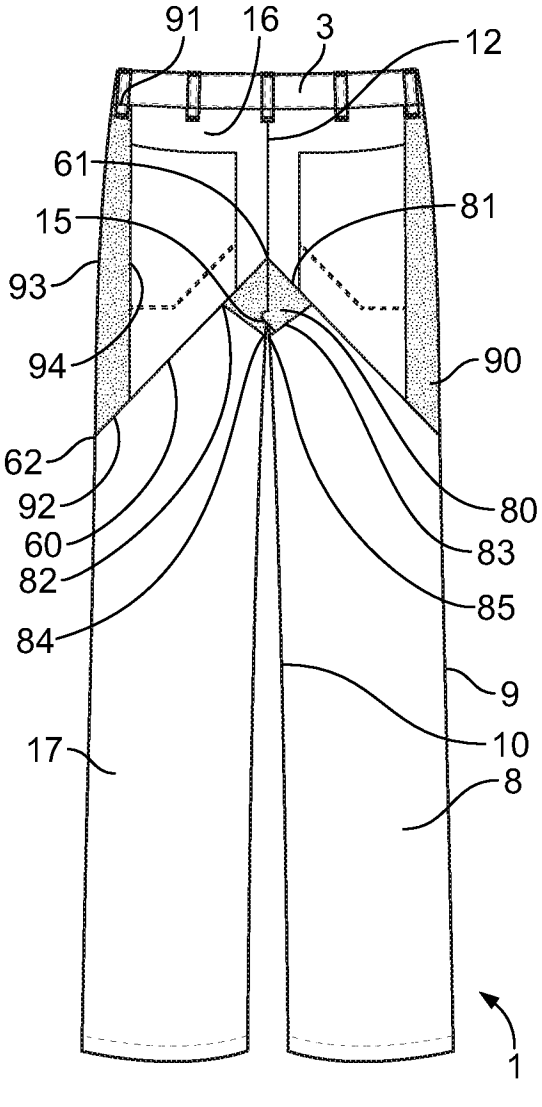
FIG. 11B is a rear elevation view of an embodiment of a pant configured to provide a wearer with increased mobility.
Figure 11A:
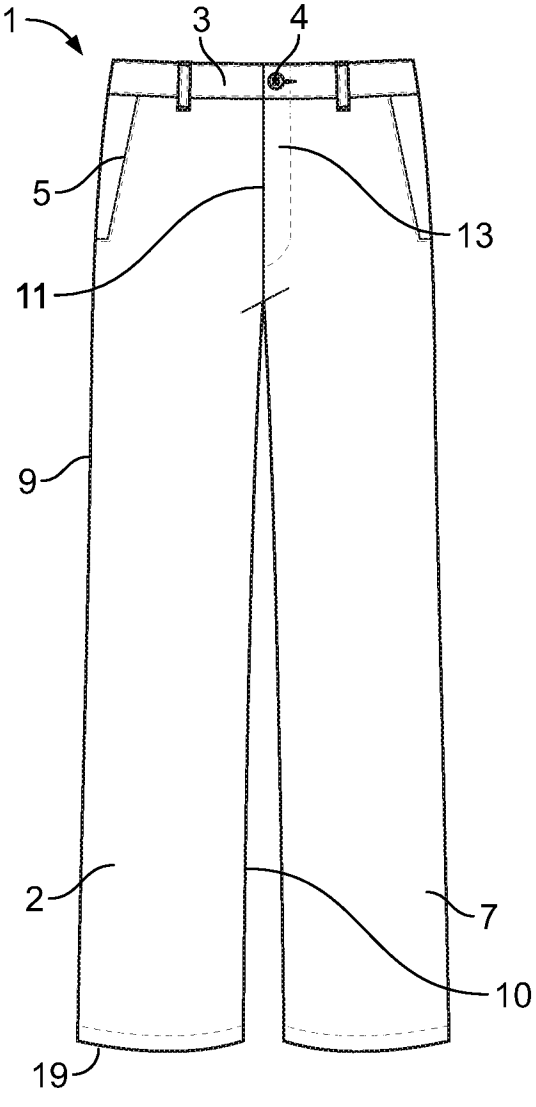
FIG. 11A is a front elevation view of an embodiment of a pant configured to provide a wearer with increased mobility.
Figure 12A:
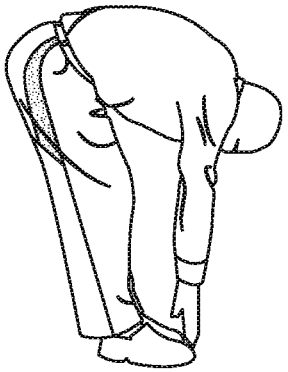
FIG. 12A is a perspective view of the embodiment shown in FIGS. 10 and 11 providing a wearer with increased mobility when subjected to the bending over movement.
Figure 12B:
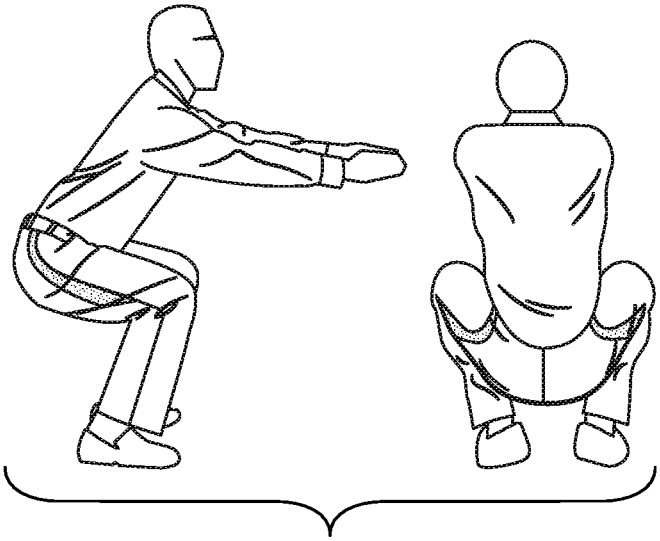
FIG. 12B is a perspective view of the embodiment shown in FIGS. 10 and 11 providing a wearer with increased mobility when subjected to the squatting movement.
Figure 12C:
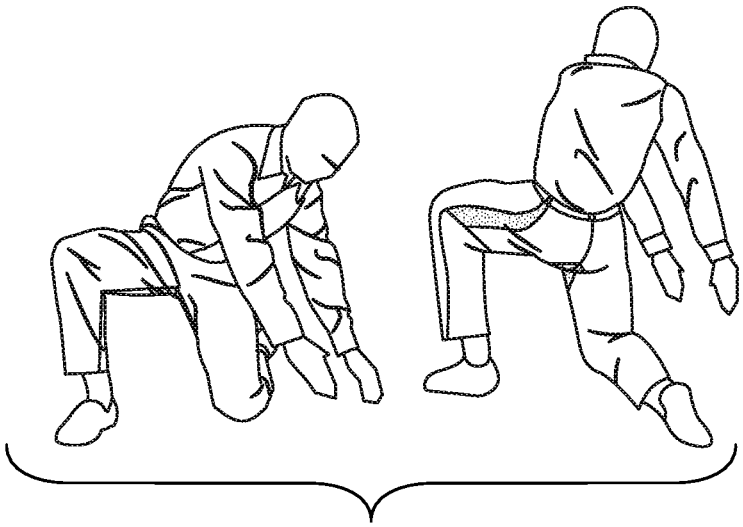
FIG. 12C is a perspective view of the embodiment shown in FIGS. 10 and 11 providing a wearer with increased mobility when subjected to the kneeling and twisting movement.
Figure 12D:
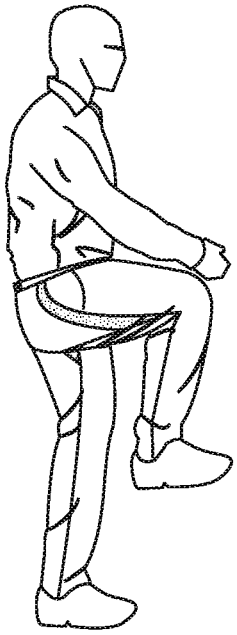
FIG. 12D is a perspective view of the embodiment shown in FIGS. 10 and 11 providing a wearer with increased mobility when subjected to the big step movement.

An embodiment of the present invention is illustrated in FIGS. 10 through 12. The embodiment illustrated in FIG. 10 through 12 comprises a first stretch panel 80 located at a micro-site of the first leg 2 and a second stretch panel 80 located at a micro-site of the second leg. Each of the stretch panels 80 is configured to extend downward from a top edge 81 that coincides with the substantially diagonal seam 60. Accordingly, stretch panels 80 are located entirely on the lower portions 17 of the rear panels 8 of the legs. In some embodiments, the top edge 81 of each stretch panel 80 is configured to coincide with the substantially diagonal seam 60 starting at point 61 (at which the substantially diagonal seam 60 intersects the rear seam of the pant 12) and running downward and outward to an outer point 82.

The location of point 61, e.g. the distance of point 61 from the bottom of the waistband 3, may vary widely depending on the size of the pants. In some embodiments, for example, point 61 may be positioned between about 5 inches and about 15 inches below the bottom of the waistband 3, as measured from the point at which the rear seam 12 intersects the waistband. Alternatively, point 61 may be between about 6 inches and about 14 inches below the bottom of the waistband, alternatively between about 6 inches and about 12 inches below the bottom of the waistband.

The outer point 82 is positioned along the diagonal seam 60 at a location between point 61 (at which the substantially diagonal seam 60 intersects the rear seam of the pant 12) and point 62 (at which the substantially diagonal seam intersects the outer seam of the leg 9). The location of point 82 may vary widely depending on the size of the pants and the desired size of the stretch panel 80. In some embodiments, for example, the outer point 82 may be located at a distance from point 61 (i.e. the top edge 81 of the stretch panel may span a distance) that is between about 2 inches and about 10 inches, alternatively between about 2 inches and about 8 inches, alternatively between about 3 and about 7 inches along the diagonal seam 60.

In some embodiments, the stretch panel 80 may also be configured so that the outer point 82 is located at a particular distance below the bottom edge of the waistband 3. Again, the location of point 82 will vary widely depending on the size of the pants. In some embodiments, for example, the outer point 82 may be between about 6 inches and about 24 inches below the bottom of the waistband 3, alternatively between about 7 inches and about 20 inches below the bottom edge of the waistband, alternatively between about 8 inches and about 15 inches below the bottom edge of the waistband, alternatively between about 9 inches and about 13 inches below the bottom edge of the waistband.

Although the top edge 81 of stretch panel 80 in the embodiment illustrated in FIGS. 10-12 is straight, in some embodiments the top edge 81 may not form a straight line. For example, in other (non-illustrated) embodiments the substantially diagonal seam, and hence the top edge 81 of stretch panel 80 may be less straight than the embodiment illustrated in FIGS. 10-12, and may curve or bend in either a downward or an upward direction.

The stretch panel 80 also comprises a bottom edge 83 that extends substantially diagonally, downward and inward, from the outer point 82 to a lower point 84 at the inner seam 10 of the leg portion. Although the bottom edge 83 of stretch panel 80 in the embodiment illustrated in FIGS. 10-12 is straight, in some embodiments the bottom edge 83 may not form a straight line. For example, in other (non-illustrated) embodiments the bottom edge 83 of stretch panel 80 may be less straight than the embodiment illustrated in FIGS. 10-12, and may curve or bend in either a downward or an upward direction.

The location of lower point 84, i.e. the distance of point 84 below the crotch seam 15, will vary widely depending on the size of the pant. In some embodiments, for example, point 84 is preferably located between about 1 and about 10 inches below the crotch seam 15 of the pant, alternatively between about 2 and about 8 inches, alternatively between about 3 and about 7 inches. The length of the bottom edge 83 will also vary depending on the size of the pants and the selected positions of point 82 and point 84. In some embodiments, for example, the bottom edge 83 may span a distance (between point 82 and point 84) that is between about 3 inches and about 12 inches, alternatively between about 4 inches and about 10 inches, alternatively between about 5 inches and about 8 inches.

By positioning the outer point 82 at a desired location along the substantially diagonal seam 60 and by configuring the stretch panel 80 so that the top and bottom edges form a desired angle at the outer point 82, significant improvements in mobility may be achieved using a relatively small amount of stretch fabric.

The stretch panel 80 also comprises an inner edge 85. In some embodiments, at least a portion of the inner edge 85 of the stretch panel 80 may coincide with the inner seam 10 of the leg portion. For example, at least a portion of the inner edge 85 of the stretch panel 80 may run along the inner seam 10 of the leg portion between point 84 and the crotch seam 15 of the pant. Another portion of the inner edge 85 of the stretch panel may coincide with the rear seam 12 of the pant, for example running along the rear seam 12 of the pant between point 61 and the crotch seam 15. In some embodiments, the distance between lower point 84 and the crotch seam 15 may be substantially equal to the distance between point 61 (the upper point of the stretch panel 80) and the crotch seam, meaning that the crotch seam falls at or near the center of the inner edge 85 of the stretch panel.

The stretch panels 80 may be configured so that they are entirely positioned on the rear panels 8 of the leg portions. The front panels 7 of the leg portions may not contain any stretch panels and may therefore have an appearance that is identical with conventional pants.

In some embodiments, each leg of the pant may also contain one or more additional stretch panels 90 located on the rear panel 8 of the leg, at or near the outer thigh. For example, the pant may also comprise a third stretch panel 90 that is positioned at one or more microsites at the outer thigh of the first leg and a fourth stretch panel that is positioned at one or more microsites at the outer thigh of the second leg.

Each of the stretch panels 90 may span a width between a front edge 93 and a rear edge 94. In some embodiments, the front edge 93 may coincide with the outer seam 9 of the pant. Accordingly, the stretch panels 90 may be configured so that they are entirely positioned on the rear panels 8 of the leg portions. The front panels 7 of the leg portions may contain no stretch panels and may have an appearance that is identical with conventional pants.

The width of the stretch panel 90 may be selected depending on the size and intended usage of the pant 1, to provide the desired amount of stretchability to the pant while at the same time minimizing the dimensions of the stretch panel 90 (and accordingly the amount of stretch material used in the garment). For example, the rear edge 94 may be located between about ½ inch and about 12 inches from the front edge 93, alternatively between about ½ inch and about 10 inches, alternatively between about 1 inch and about 8 inches, alternatively between about 1 inch and about 6 inches, alternatively between about 1 inch and about 5 inches.

These values should be understood as being the average width of the stretch panel 90 between the front edge 93 and the rear edge 94. As shown in the embodiment illustrated in FIGS. 10-12, the rear edge 94 of the stretch panel 90 may not be wholly vertical and therefore the width of the stretch panel may vary. For example, in some embodiments, it may be desirable that the stretch panel 90 have a greater width at its bottom than at its top. This configuration provides for a sufficient amount of stretch fabric at a microsite located near the point 62 at which the substantially diagonal seam 60 intersects the outer seam 9 of the leg, while at the same time requiring less stretch fabric to be used at the upper end of the stretch panel.

The location of point 62, e.g. the distance of point 62 from the bottom of the waistband 3, may vary widely depending on the size of the pants. In some embodiments, for example, point 62 may be positioned between about 10 inches and about 25 inches below the bottom of the waistband 3, as measured from the point at which the outer seam of the leg 9 intersects the waistband. Alternatively, the point 62 may be positioned between about 11 inches and about 24 inches below the bottom of the waistband 3, alternatively between about 12 inches and about 24 inches below the bottom of the waistband, alternatively between about 13 inches and about 23 inches below the bottom of the waistband, alternatively between about 15 inches and about 23 inches, alternatively between about 16 inches and about 22 inches.

Each of the stretch panels 90 may have a length that extends substantially vertically between a top edge 91 and a bottom edge 92. The bottom edge 92 preferably coincides with the substantially diagonal seam 60. In some embodiments, for example, the bottom edge 92 may extend between about 1 inch and about 8 inches, alternatively between about 2 inches and about 6 inches, along the substantially diagonal seam 60.

In some embodiments, such as that illustrated in FIGS. 10-12, the top edge 91 (or in some cases point) of the stretch panel 90 may coincide with the bottom edge of the waistband 3. Alternatively, the stretch panel 90 may comprise a top edge 91 that is located near, but not coinciding with the waistband 3. For example, in some embodiments, the rear edge 94 may be configured to angle or curve so as to intersect the front edge 93 at a point on the outer seam of the pant 9 that is below the waistband 3, such as within three inches or within two inches of the bottom of the waistband. Alternatively, the top edge 91 may coincide with the bottom of a pocket, such as a pocket that extended from the bottom of the waistband.

Where the seat of the pant comprises substantially identical stretch panels 80, 90 on each of the first and second legs, as is shown in the embodiments illustrated in FIGS. 10-12 for example, the stretch panels 80, 90 provide for enhanced mobility over the range of movements described herein, and particularly for the squatting and big step movements. The stretching of an embodiment such as described above in response to the motions used during the mobility mapping process is shown in FIGS. 12A through 12D. The embodiment illustrated comprises a pair of stretch panels 80, 90 positioned on the rear of the pant. As a wearer performs the range of motions, the stretch panels 80, 90 provide for stretching of the pant 1 at the identified micro sites in order to provide significant improvements in a wearer's comfort, performance, and mobility.

Testing

To demonstrate the effectiveness of embodiments of the present invention, mobility testing was performed. In one test, multiple test subjects were provided with multiple pairs of pants. Each pant was designed to have substantially the same dimensions. One pant was a control, which did not contain any stretch panels. A first test pant was of the same sort as the embodiment illustrated in FIGS. 7 through 9, which contained matching stretch panels 70 on the seat of the pant. A second test pant was of the same sort as the embodiment illustrated in FIGS. 10 through 12, which contained matching stretch panels 80, 90 on the seat of the pant. Each test subject was then instructed to don each pair of pants while performing a range of movements.

Figure 1B:
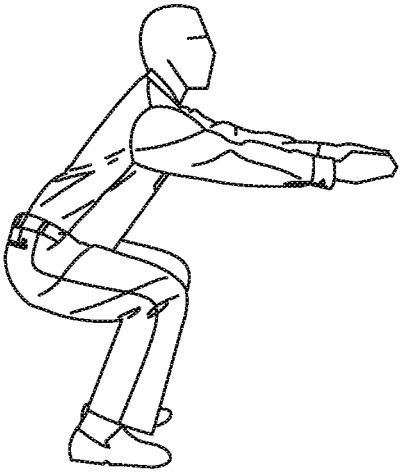
FIG. 1B is an illustration of the squatting movement, one of the five movements used to locate micro sites on embodiments of the pants described herein.
Figure 1C:
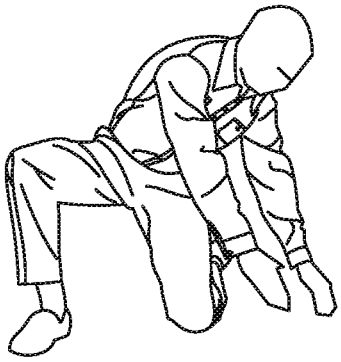
FIG. 1C is an illustration of the kneeling and twisting movement, one of the five movements used to locate micro sites on embodiments of the pants described herein.
Figure 1D:
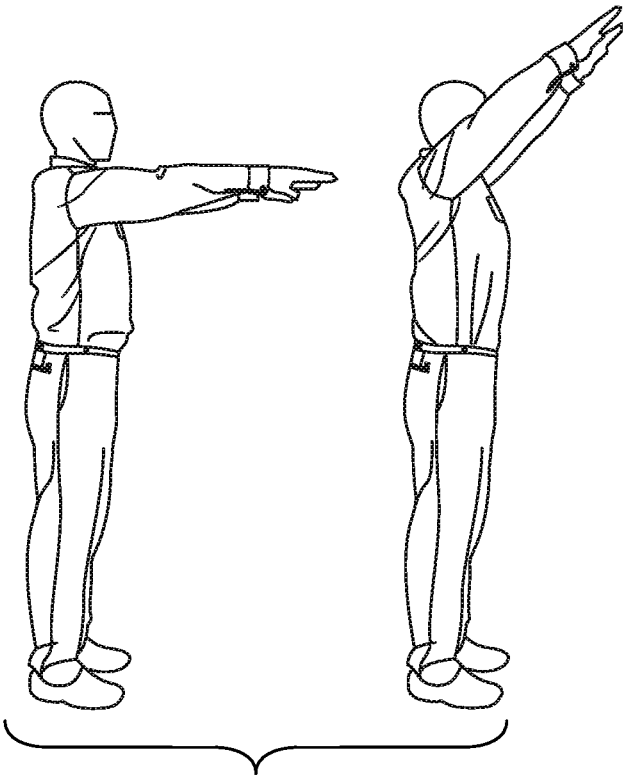
FIG. 1D is an illustration of the reaching forward and up movement, one of the five movements used to locate micro sites on embodiments of the pants described herein.

In one test, each subject was instructed to perform the squatting motion illustrated in FIG. 1B. Prior to performing the squatting motion, a marker was provided on each test subject at a location corresponding to the top of the pant waistband 3 during normal wear, i.e. at the normal resting position of the pant. While each subject performed the squatting motion, the location of the top of the pant waistband 3 was measured. In each subject, the top of the waistband 3 during squatting was located below its normal resting point. This effect may be known as yoke travel.

For each test subject, the amount of yoke travel that occurred when wearing the control sample was measured and the average amount of travel across the test subjects was calculated. The amounts of yoke travel that occurred when wearing each of the first test sample and the second test sample were also measured for each test subject and the average amount of yoke travel across the test subjects was calculated. It was determined that the average yoke travel of the first test sample was about 22% less than the control and the average yoke travel of the second test sample was about 15% less than the control. Each of these reductions was significant enough to be noticeable by the wearer. Some embodiments of the present invention are directed to a pant containing stretch panels, such as stretch panels 70, 80, 90, that are effective to reduce the amount of yoke travel by at least 10%, alternatively at least 12%, alternatively at least 15%, alternatively at least 20%.

Figure 1E:
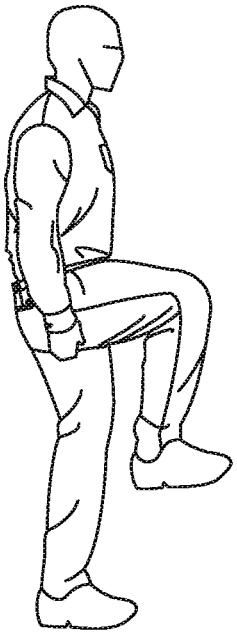
FIG. 1E is an illustration of the big step movement, one of the five movements used to locate micro sites on embodiments of the pants described herein.

In another test, each subject was instructed to perform each of the squatting and big step motions illustrated in FIGS. 1B and 1E respectively. Prior to performing each motion, a marker was provided on each test subject at a location corresponding to the bottom edge of the pant leg 19 during normal wear, i.e. at the normal resting position of the pant. While each subject performed the squatting and big step motions, the location of the bottom edge of the pant leg 19 was measured. In each subject, the bottom edge of the pant leg 19 during the squatting and big step motions was located above its normal resting position. The distance travelled by the bottom edge of the pant leg 19 over the two movements was averaged to obtain a single value, which was representative of the effect. This effect may be known as ankle travel.

For each test subject, the amount of ankle travel that occurred when wearing the control sample was measured and the average amount of travel across the test subjects was calculated. The amounts of ankle travel that occurred when wearing each of the first test sample and the second test sample were also measured for each test subject and the average amount of ankle travel across the test subjects was calculated. It was determined that the average ankle travel of the first test sample was about 12% less than the control and the average ankle travel of the second test sample was about 11% less than the control. Each of these reductions was significant enough to be noticeable by the wearer. Some embodiments of the present invention are directed to a pant containing stretch panels, such as stretch panels 70, 80, 90, that are effective to reduce the amount of ankle travel by at least 8%, alternatively at least 10%, alternatively at least 12%.

The above-described effects are likely to vary depending on the sizes of the test subjects. Accordingly, all stated values are intended to be values that are representative of an average wearer. For example, test subjects with relatively bigger waists and/or bigger thighs are expected to see more of an effect on mobility while test subjects with relatively smaller waists and/or smaller thighs are expected to see less of an effect on mobility.

It should be understood that none of the pants 1 described and/or claimed herein are in any way limited by the process in which they were designed or produced. In other words, although the pants 1 described and/or claimed herein were developed in part by identifying certain micro-sites across a range of movements using the mobility mapping process described above, that process should in no way be considered a required component or element of the pants themselves.

It can be seen that the described embodiments provide unique and novel pants that have a number of advantages over those in the art. While there is shown and described herein certain specific structures embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A pant configured for enhanced mobility, comprising:

a first leg portion and a second leg portion, each of the first leg portion and the second leg portion comprising a front panel and a rear panel;

a waistband;

a rear seam extending vertically downward from the waist band, the rear seam separating the rear panel of the first leg portion and the rear panel of the second leg portion;

at least one stretch panel located on the rear panel of the first leg portion; and at least one stretch panel located on the rear panel of the second leg portion;

wherein the rear panels of the first leg portion and second leg portion are each divided into an upper region and a lower region by a substantially diagonal seam, the substantially diagonal seam extending from a point at the rear seam positioned at least 4 inches below the bottom of the waistband of the pant downward to a point at an outer seam of the leg portion;

wherein a bottom edge of each of the stretch panels coincides with each of the substantially diagonal seams and extends along the entire length of the diagonal seam;

wherein an outer edge of each of the stretch panels coincides with the outer seam of the leg, such that each of the stretch panels does not extend onto the front panel; and wherein each of the stretch panels provides a wearer with enhanced mobility when performing one or more of the following motions: (a) bending over, (b) squatting, (c) kneeling and twisting, (d) reaching forward and up, and (e) big step.

2. The pant of claim 1, the pant further comprising a waistband, and wherein the point at the rear seam of the pant is located between 6 inches and 10 inches below the bottom edge of the waistband.

3. The pant of claim 2, wherein the point at the outer seam of the leg portion is located between 12 inches and 24 inches below the bottom edge of the waistband.

4. The pant of claim 1, the pant further comprising a waistband, and wherein at least a portion of a top edge of each of the stretch panels coincides with the bottom edge of the waistband.

5. The pant of claim 4, wherein at least another portion of a top edge of each of the stretch panels extends substantially diagonally from an upper point coinciding with the bottom edge of the waistband to a lower point at the outer seam of the leg portion.

6. The pant of claim 5, wherein the portion of the top edge of each of the stretch panels that extends substantially diagonally from an upper point coinciding with the bottom edge of the waistband to a lower point at the outer seam of the leg portion extends substantially downward from the bottom of the waistband a distance before extending toward the outer seam of the leg.

7. The pant of claim 1, wherein the outer edge of each of the stretch panels spans a vertical distance between 8 inches and 18 inches.

8. The pant of claim 1, wherein an inner edge of each of the stretch panels coincides with the rear seam of the pant.

9. The pant of claim 8, wherein the inner edge of each of the stretch panels spans a vertical distance between 5 inches and 10 inches.

10. The pant of claim 1, wherein the front panels of the first and second leg portions do not contain any stretch panels.

11. The pant of claim 1, wherein the pant is configured to withstand industrial laundering.

12. The pant of claim 1, wherein each of the stretch panels have a four-way stretch of at least about 25%.

13. The pant of claim 1, wherein the pant is a segment of a coverall.

14. The pant of claim 1, wherein the stretch panels are effective to provide at least a 12% reduction in yoke travel.

15. The pant of claim 1, wherein the stretch panels are effective to provide at least a 10% reduction in ankle travel.

16. A pant configured for enhanced mobility, comprising:

a first leg portion and a second leg portion, each of the first leg portion and the second leg portion comprising a front panel and a rear panel;

a waistband;

a rear seam extending downward from the waist band, the rear seam separating the rear panel of the first leg portion and the rear panel of the second leg portion;

a stretch panel located on the rear panel of the first leg portion; and a stretch panel located on the rear panel of the second leg portion;

wherein the rear panels of the first leg portion and second leg portion are each divided into an upper region and a lower region by a substantially diagonal seam, the substantially diagonal seam extending from a point at the rear seam of the pant downward to a point at an outer seam of the leg portion, wherein the point at the rear seam of the pant is located between about 4 inches and about 15 inches below a bottom edge of the waistband; and wherein a bottom edge of each of the stretch panels coincides with each of the substantially diagonal seams and extends along an entire length of the diagonal seam;

wherein a top edge of each of the stretch panels meets the bottom edge of the waistband;

wherein a first portion of a top edge of each of the stretch panels coincides with the bottom edge of the waistband and a second portion of a top edge of each of the stretch panels extends substantially diagonally from an upper point coinciding with the bottom edge of the waistband to a lower point at the outer seam of the leg portion;

wherein the portion of the top edge of each of the stretch panels that extends substantially diagonally from an upper point coinciding with the bottom edge of the waistband to a lower point at the outer seam of the leg portion extends downward from the bottom of the waistband a distance before extending toward the outer seam of the leg; and wherein an outer edge of each of the stretch panels coincides with the outer seam of the leg, such that each stretch panel does not extend onto the front panel, and an inner edge of each of the stretch panels coincides with the rear seam of the pant.

17. The pant of claim 16, wherein the outer edge of each of the stretch panels spans a vertical distance between 8 inches and 18 inches.

18. The pant of claim 16, wherein the front panels of the first and second leg portions do not contain any stretch panels.

* * * * *